US011034012B2

(12) United States Patent
Fuchs et al.

(10) Patent No.: US 11,034,012 B2
(45) Date of Patent: Jun. 15, 2021

(54) HAND-HELD POWER TOOL IN WHICH THE DIRECTION OF ROTATION CAN BE SET

(71) Applicant: Robert Bosch GmbH, Stuttgart (DE)

(72) Inventors: Rudolf Fuchs, Neuhausen (DE); Florian Bantle, Westerheim (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 297 days.

(21) Appl. No.: 16/061,773

(22) PCT Filed: Dec. 7, 2016

(86) PCT No.: PCT/EP2016/080141
§ 371 (c)(1),
(2) Date: Jun. 13, 2018

(87) PCT Pub. No.: WO2017/102518
PCT Pub. Date: Jun. 22, 2017

(65) Prior Publication Data

US 2018/0361558 A1 Dec. 20, 2018

(30) Foreign Application Priority Data

Dec. 18, 2015 (DE) ..... 10 2015 226 087.9

(51) Int. Cl.
*B25F 5/00* (2006.01)
*B25B 21/00* (2006.01)

(52) U.S. Cl.
CPC ..... *B25F 5/001* (2013.01); *B25F 5/00* (2013.01); *B25B 21/00* (2013.01)

(58) Field of Classification Search
CPC ..... B25B 23/147; B25B 23/1475; B25B 23/1405; B25B 23/1425; B25B 21/00; B25F 5/001; B25F 5/00
(Continued)

(56) References Cited

U.S. PATENT DOCUMENTS 6,536,536 B1 * 3/2003 Gass ..... B23B 31/123 173/171
7,036,605 B2 * 5/2006 Suzuki ..... B25B 21/02 173/176

(Continued)

FOREIGN PATENT DOCUMENTS

DE 20107583 U1 * 9/2002 ..... H01H 23/14
DE 201 07 583 U1 10/2002

(Continued)

OTHER PUBLICATIONS

DE20107583U1 Machine Translation (Year: 2020).*

(Continued)

*Primary Examiner* — Anna K Kinsaul
*Assistant Examiner* — Veronica Martin
(74) *Attorney, Agent, or Firm* — Maginot, Moore & Beck LLP

(57) ABSTRACT

A hand-held power tool includes an output spindle and a drive unit configured to rotationally drive the output spindle such that the drive unit can be changed over between a first direction of rotation and a second direction of rotation in order to drive the output spindle in the first or second direction of rotation. The hand-held power tool further includes at least one operating element configured to initiate a changeover operation for changing over the drive unit between the first direction of rotation and the second direction of rotation such that the at least one operating element is in form of a monostable switching element.

13 Claims, 18 Drawing Sheets

(58) Field of Classification Search
USPC ..... 173/176, 11, 217
See application file for complete search history.

(56) References Cited

U.S. PATENT DOCUMENTS 7,182,148 B1 * 2/2007 Szieff ..... B25B 21/00 173/171
8,640,789 B2 * 2/2014 Harada ..... B25B 21/02 173/176
9,712,091 B2 * 7/2017 Sawano ..... H02P 6/22
10,454,391 B2 * 10/2019 Bantie ..... H02P 1/22
2002/0060082 A1 * 5/2002 Watanabe ..... B25B 23/1405 173/176
2003/0047331 A1 * 3/2003 Henderson ..... B23P 19/066 173/4
2005/0121209 A1 * 6/2005 Shimizu ..... B25B 21/00 173/217
2005/0205274 A1 * 9/2005 Bogue ..... B25B 21/02 173/2
2007/0034394 A1 * 2/2007 Gass ..... B25H 1/0092 173/2
2011/0162860 A1 * 7/2011 Gut ..... B25F 5/001 173/1
2011/0284256 A1 * 11/2011 Iwata ..... B25F 5/00 173/176
2013/0167691 A1 * 7/2013 Ullrich ..... B25B 23/0064 81/57.11
2013/0186666 A1 * 7/2013 Yoshino ..... B25B 23/1475 173/176
2013/0255981 A1 * 10/2013 Noto ..... B25F 5/00 173/20
2013/0327552 A1 * 12/2013 Lovelass ..... B25B 23/147 173/1
2014/0008093 A1 * 1/2014 Patel ..... B25F 5/00 173/217
2014/0014385 A1 * 1/2014 Kosugi ..... B25B 21/00 173/217
2014/0048298 A1 * 2/2014 Fuchs ..... B25B 23/147 173/1
2014/0102742 A1 * 4/2014 Eshleman ..... B25B 23/147 173/183
2014/0166323 A1 * 6/2014 Cooper ..... F16P 3/148 173/1
2014/0166324 A1 * 6/2014 Puzio ..... B25F 5/001 173/20
2014/0338939 A1 * 11/2014 Shi ..... H02P 29/032 173/1
2014/0367134 A1 * 12/2014 Phillips ..... B25B 23/147 173/176
2014/0371018 A1 * 12/2014 Ito ..... B25F 5/001 475/149
2014/0374130 A1 * 12/2014 Nakamura ..... B25D 11/00 173/176
2015/0122523 A1 * 5/2015 Yamamoto ..... B25F 5/001 173/2
2015/0328763 A1 * 11/2015 Ito ..... H02J 7/00 451/359
2018/0354108 A1 * 12/2018 Lee ..... B25B 23/147

FOREIGN PATENT DOCUMENTS

EP 2 426 225 A 11/2006
EP 2 671 681 A2 12/2013
EP 2 743 020 A2 6/2014
GB 2426225 A * 11/2006 ..... B25F 5/00

OTHER PUBLICATIONS

International Search Report corresponding to PCT Application No. PCT/EP2016/080141, dated Mar. 1, 2017 (German and English language document) (7 pages).

* cited by examiner

HAND-HELD POWER TOOL IN WHICH THE DIRECTION OF ROTATION CAN BE SET

This application is a 35 U.S.C. § 371 National Stage Application of PCT/EP2016/080141, filed on Dec. 7, 2016, which claims the benefit of priority to Serial No. DE 10 2015 226 087.9, filed on Dec. 18, 2015 in Germany, the disclosures of which are incorporated herein by reference in their entirety.

BACKGROUND

The disclosure relates to a hand-held power tool having a drive unit for rotationally driving an output spindle, wherein the drive unit can be changed over between a first direction of rotation and a second direction of rotation in order to make it possible to drive the output spindle in the first or second direction of rotation, wherein at least one operating element is provided to initiate a changeover operation for changing over the drive unit between the first direction of rotation and the second direction of rotation.

The prior art discloses such hand-held power tools having a drive unit with a drive motor for rotationally driving an output spindle which can be changed over between a first direction of rotation and a second direction of rotation. These hand-held power tools have an operating element for initiating the operation of changing over between the two different directions of rotation.

In addition, DE 201 07 583 U1 discloses a hand-held power tool having a monostable switch for reversing the direction of rotation, which switch comprises a circuit board having switching elements fitted thereto and a switching handle for actuating the switching elements. In this case, the switching handle is in the form of a switching rocker or rocker switch for actuating either the one switching element or the other switching element by means of tilting and is rotatably mounted on the housing of the hand-held power tool. In this case, the monostable switch comprises a spring rod which is unloaded in a stable central position of the switching handle and can be deflected in an elastically deformable manner by tilting the switching handle. The monostable switch can therefore actuate two different switching elements from its stable central position.

SUMMARY

The disclosure provides a new hand-held power tool having a drive unit for rotationally driving an output spindle, wherein the drive unit can be changed over between a first direction of rotation and a second direction of rotation in order to make it possible to drive the output spindle in the first or second direction of rotation, wherein at least one operating element is provided to initiate a changeover operation for changing over the drive unit between the first direction of rotation and the second direction of rotation. The at least one operating element is in the form of a monostable switching element.

The disclosure therefore makes it possible to provide a hand-held power tool in which the operating element for initiating the changeover operation between the first direction of rotation and the second direction of rotation is in the form of a monostable switching element. It is therefore possible for a user of the hand-held power tool to change over the drive unit between the first direction of rotation and the second direction of rotation in a simple and uncomplicated manner.

The at least one operating element in the form of a monostable switching element is preferably assigned a sensor unit which is designed to generate a corresponding actuation signal when the operating element is actuated. It is therefore possible to signal the actuation of the operating element in a simple manner.

The actuation signal can preferably be used to set a respectively desired direction of rotation of the output spindle. It is therefore possible to safely and reliably set the current direction of rotation of the output spindle.

The sensor unit preferably has a mechanical, electrical, magnetic and/or optical sensor. Actuation of the operating element can therefore be captured in a cost-effective manner.

According to one embodiment, a direction of rotation detection unit is provided and is designed to detect a respectively current direction of rotation of the drive unit. A current direction of rotation of the drive unit can therefore be expediently and reliably detected.

A direction of rotation detection unit is preferably provided and is designed to indicate a request to initiate a changeover operation for changing over the drive unit between the first direction of rotation and the second direction of rotation when predefined operating conditions occur. A request to initiate a changeover operation for changing over the drive unit between the first direction of rotation and the second direction of rotation can therefore be indicated in a safe and uncomplicated manner.

The at least one operating element in the form of a monostable switching element preferably has a switching rocker, a pushbutton or a slide. The at least one operating element in the form of a monostable switching element can therefore be implemented in a versatile and expedient manner.

The at least one operating element in the form of a monostable switching element is preferably assigned at least one spring element which moves the operating element into a stable position. The at least one operating element in the form of a monostable switching element can therefore be safely and reliably moved into a stable position.

The at least one operating element in the form of a monostable switching element is preferably provided with an illumination means and the illumination means is designed to indicate a request to initiate a changeover operation for changing over the drive unit between the first direction of rotation and the second direction of rotation when predefined operating conditions occur. A request to initiate a changeover operation for changing over the drive unit between the first direction of rotation and the second direction of rotation can therefore be indicated in a simple manner.

According to one embodiment, the drive unit has a drive motor and control electronics are provided and are designed to cause a changeover operation for changing over the drive motor between the first direction of rotation and the second direction of rotation when the at least one operating element in the form of a monostable switching element is actuated. Actuation of the at least one operating element in the form of a monostable switching element can therefore safely and precisely cause a changeover operation for changing over the drive motor between the first direction of rotation and the second direction of rotation.

The control electronics are preferably designed to cause the changeover operation for changing over the drive motor between the first direction of rotation and the second direction of rotation only when the drive motor is at a standstill. It can therefore be reliably ensured that the changeover operation for changing over the drive motor between the first direction of rotation and the second direction of rotation is caused only when the drive motor is at a standstill.

The control electronics are preferably designed to brake the drive motor to a standstill in order to enable the changeover operation for changing over the drive motor between the first direction of rotation and the second direction of rotation. The control electronics can therefore make it possible to initiate the changeover operation for changing over the drive motor between the first direction of rotation and the second direction of rotation, to be precise irrespective of whether or not the drive motor is at a standstill.

According to one embodiment, the at least one operating element in the form of a monostable switching element has a touch-sensitive screen. The at least one operating element in the form of a monostable switching element can therefore be operated in a simple manner.

The touch-sensitive screen is preferably designed to make it possible to indicate a request to initiate a changeover operation for changing over the drive unit between the first direction of rotation and the second direction of rotation and to initiate the changeover operation. A request to initiate a changeover operation for changing over the drive unit between the first direction of rotation and the second direction of rotation can therefore be indicated and the changeover operation can be initiated in an uncomplicated manner and in a manner which is clearly discernible for a user.

According to one embodiment, the hand-held power tool is in the form of a cordless screwdriver or a cordless drill/screwdriver. The hand-held power tool having the at least one operating element in the form of a monostable switching element can therefore be flexibly implemented in the form of a cordless screwdriver or a cordless drill/screwdriver.

BRIEF DESCRIPTION OF THE DRAWINGS

The disclosure is explained in more detail in the following description on the basis of exemplary embodiments which are illustrated in the drawings. In the drawings, the same structural elements having identical functionalities each have the same reference numerals and are generally described only once. In the drawings.

DETAILED DESCRIPTION

Figure 1:
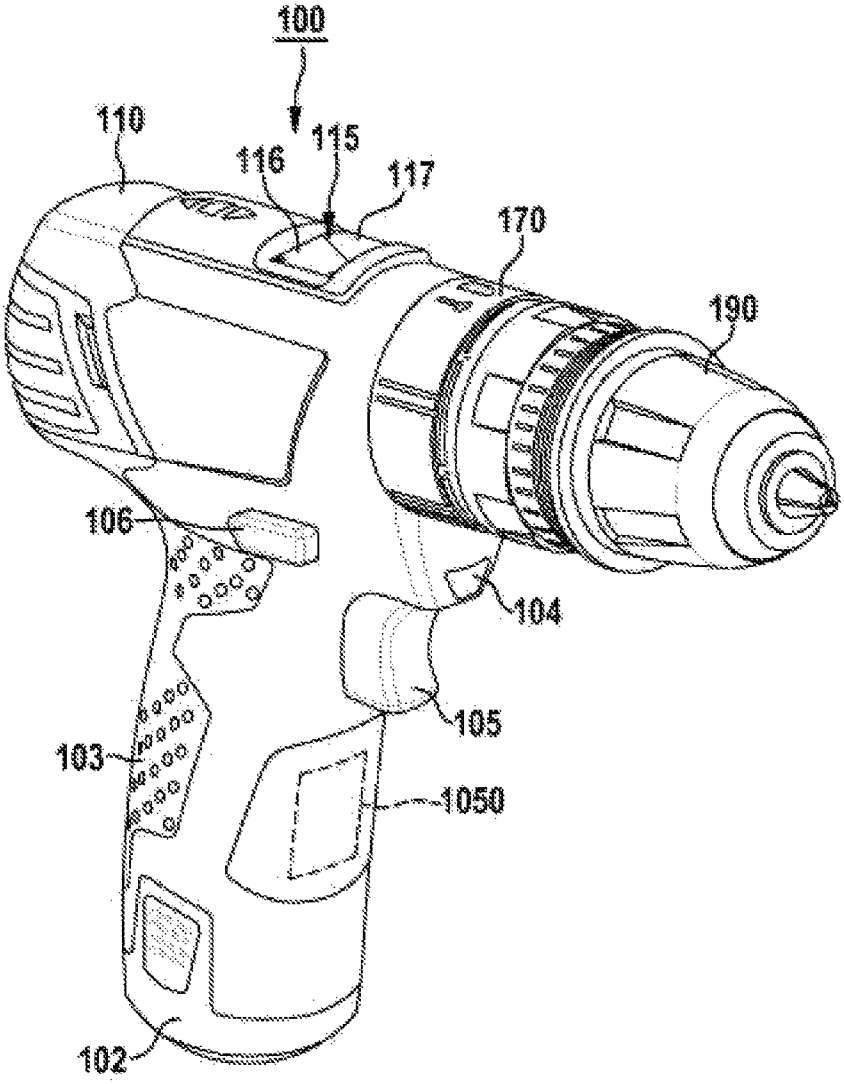
FIG. 1 shows a perspective view of a hand-held power tool having a communication interface and an operating element for initiating a changeover operation for changing over a drive unit between a first direction of rotation and a second direction of rotation.

FIG. 1 shows an exemplary hand-held power tool 100 having a housing 110 in which at least one drive unit (220 in FIG. 2) having at least one drive motor (120 in FIG. 2) is arranged for the purpose of rotationally driving an output spindle (310 in FIG. 3) or driving an insertion tool which can be arranged in a tool holder 190 and can preferably be exchanged. In this case, the housing 110 has a handle 103 with a manual switch 105. The drive motor (120 in FIG. 2) can be actuated, that is to say switched on and off, via the manual switch 105, for example, and can preferably be electronically controlled or regulated in such a manner that both reversing operation and specifications with regard to a desired rotational speed can be implemented.

Figure 2:
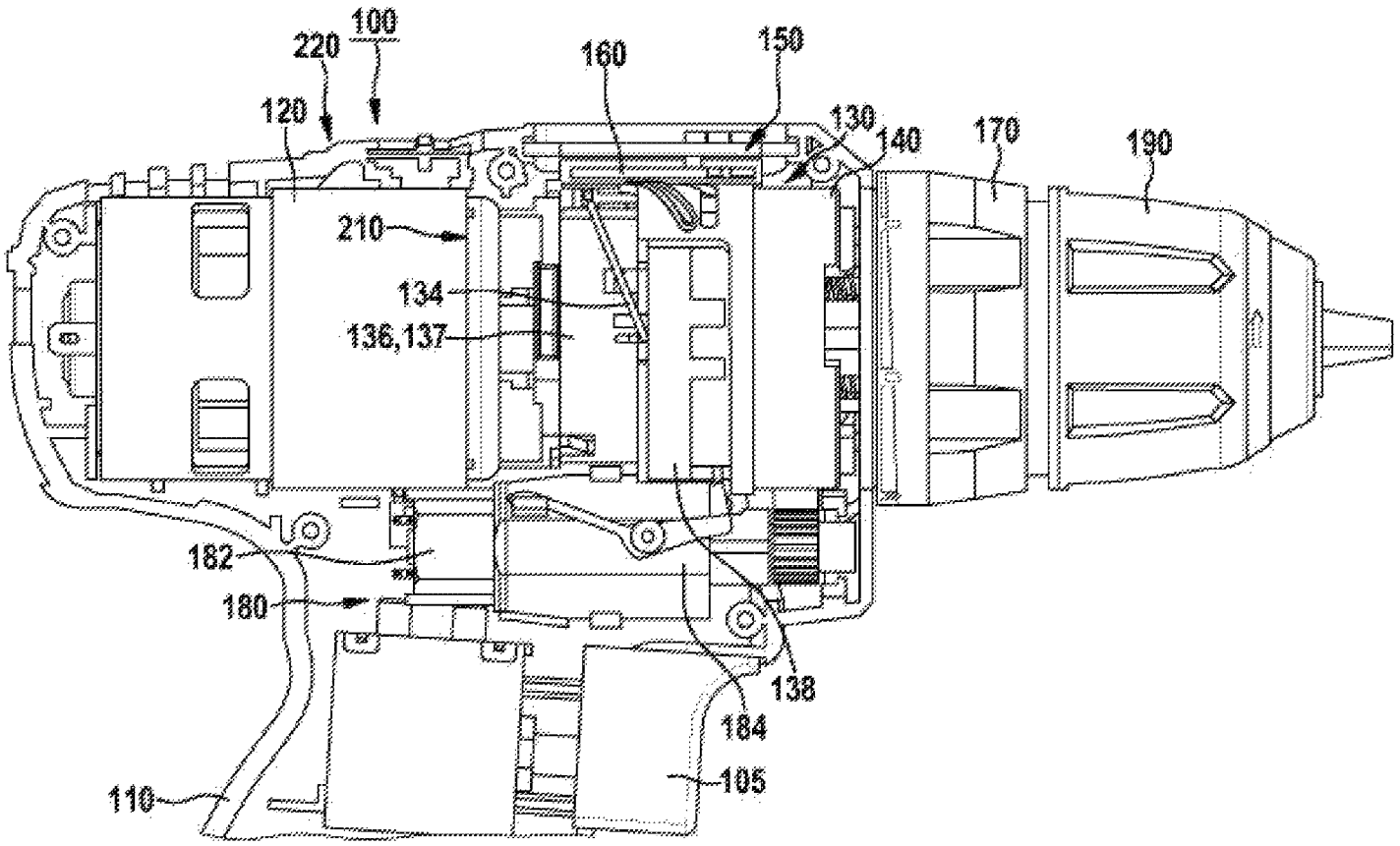
FIG. 2 shows a partially sectional side view of the hand-held power tool from FIG. 1 with the drive unit.

In addition, an operating element 106 for initiating a changeover operation for changing over the drive unit (220 in FIG. 2) between a first direction of rotation and a second direction of rotation is preferably arranged in the region of the manual switch 105 and can preferably be used to set a direction of rotation of the drive motor (120 in FIG. 2) or of the output spindle (310 in FIG. 3) which can be at least indirectly driven by the drive motor (120 in FIG. 2). The operating element 106 is preferably formed by at least one monostable switching element, for example by a switching rocker (406 in FIG. 4), a slide (706 in FIG. 8) or a pushbutton (1235 in FIG. 14).

The hand-held power tool 100 preferably has an optional switchable transmission (130 in FIG. 2), which can be changed over at least between a first gear and a second gear, and an optional percussion mechanism (not illustrated). By way of illustration, the hand-held power tool 100 is in the form of a percussion drill/screwdriver or a drill/screwdriver, wherein the first gear corresponds to a screwing mode, for example, and the second gear corresponds to a drilling or percussion drilling mode. However, further gears can also be implemented, with the result that the drilling mode is assigned to the second gear and the percussion drilling mode is assigned to a third gear, etc., for example. Alternatively, the hand-held power tool 100 can also be only in the form of a cordless screwdriver or a cordless drill/screwdriver which has at least the operating element 106 for initiating a changeover operation for changing over the drive unit (220 in FIG. 2) between the first direction of rotation and the second direction of rotation. In this case, the hand-held power tool 100 can preferably be connected to a rechargeable battery pack 102 for the purpose of being supplied with power in a manner independent of the mains, but may alternatively also be operated from the mains.

According to one embodiment, at least one user guidance unit 115 is provided and is designed at least to change over the drive motor (120 in FIG. 2) or the output spindle (310 in FIG. 3), which can be at least indirectly driven by the drive motor, between the first direction of rotation and the second direction of rotation. The user guidance unit 115 is also preferably designed to set the first or second gear required during the respectively current operation. The user guidance unit 115 can be designed for active and/or passive user guidance during a corresponding operation of changing over between the first direction of rotation and the second direction of rotation. In the case of active user guidance, a user of the hand-held power tool 100 is preferably guided, by means of visual, auditory and/or haptic instructions or requests, to change over in a corresponding changeover operation, whereas a corresponding changeover operation is automatically carried out in the case of passive user guidance and is preferably only indicated to the user. Exemplary implementations of active and passive user guidance are described in detail below.

The user guidance unit 115 preferably has at least one operating unit 106, 116, 117 which can be manually actuated and has at least one operating element, and by way of illustration a first operating element 106, a second operating element 116 and a third operating element 117, which can be manually actuated, wherein the operating elements 106, 116, 117 are designed to initiate a changeover operation for changing over the drive unit (220 in FIG. 2) between the first direction of rotation and the second direction of rotation and/or for initiating a changeover operation for changing over the transmission 130 between different gears. According to one embodiment, at least one of the operating elements 116, 117 has a touch-sensitive screen (1120 in FIG. 13). The touch-sensitive screen is preferably designed to make it possible to indicate (1185 in FIG. 13) a request to initiate a changeover operation for changing over the drive unit (220 in FIG. 2) between the first direction of rotation and the second direction of rotation and to initiate the changeover operation.

The user guidance unit 115 preferably has a mobile computer, for example a smartphone and/or a tablet computer, and/or the operating element 116, 117 can be in the form of a display. Alternatively, it is also possible to use other so-called "smart devices", for example a watch, glasses etc., as the mobile computer.

Figure 16:
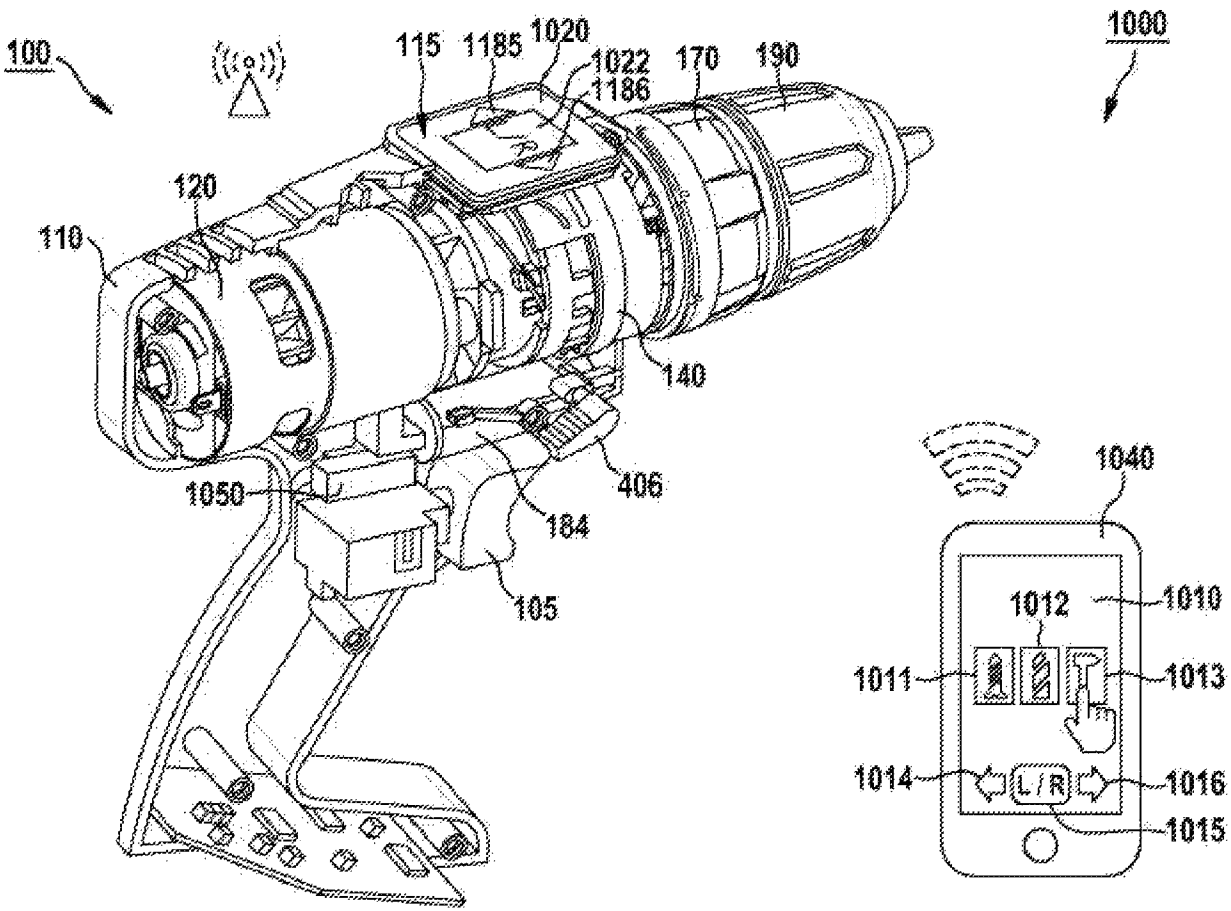
FIG. 16 shows a perspective view of a system consisting of the hand-held power tool from FIG. 1 and an operating unit according to a first embodiment.

According to one embodiment, the user guidance unit 115 is at least partially integrated in the hand-held power tool 100 and/or is at least partially in the form of an external separate component (1040 in FIG. 16). In this case, the display can be integrated in the hand-held power tool 100 and/or can be externally arranged. Changeover instructions can preferably be indicated on the display in order to at least make it easier for a user of the hand-held power tool 100 to operate and/or set, for example, an application-specific operating mode of the hand-held power tool 100.

The hand-held power tool 100 also preferably has a communication interface 1050 which is preferably provided for the purpose of communicating with the user guidance unit 115, that can preferably be actuated by a user, and is designed to receive, at least from the user guidance unit 115, changeover instructions for changing over the drive motor (120 in FIG. 2) or the output spindle (310 in FIG. 3), which can be at least indirectly driven by the drive motor, between a first direction of rotation and a second direction of rotation. The communication interface 1050 is also preferably designed to receive, from the user guidance unit 115, changeover instructions for changing over the transmission 130 between the two different gears in an application-specific manner. In this case, the communication interface 1050 is at least designed to transmit a control signal to at least one of the operating elements 106, 116, 117. In this case, it is preferably possible for at least one of the operating elements 106, 116, 117, for example, to generate a request to initiate a changeover operation for changing over the drive unit between the first direction of rotation and the second direction of rotation. It is preferably likewise possible for at least one of the operating elements 116, 117, for example, to generate a request to initiate a changeover operation for changing over the transmission 130 between the two different gears.

It is pointed out that the three operating elements 106, 116, 117 are shown as operating elements which can be used to reverse the direction of rotation in the embodiment shown in FIG. 1. However, alternatively, only the operating element 106 or one of the two operating elements 116, 117 or the two operating elements 116, 117 can also be designed to make it possible to reverse the direction of rotation of the drive unit (220 in FIG. 2) or of the drive motor (120 in FIG. 2).

According to one embodiment, the communication interface 1050 is in the form of a wireless transmission module, in particular in the form of a radio module for wireless communication by means of the Bluetooth standard. However, the transmission module may also be designed for any other wireless and/or wired communication, for example via WLAN and/or LAN.

Optional working field illumination 104 is preferably arranged on the housing 110, by way of illustration in the region of the tool holder 190, for the purpose of illuminating a working field of the hand-held power tool 100. In addition, an optional torque limitation element 170 for setting a maximum transmittable torque is assigned to the tool holder 190. In this case, the torque limitation element 170 may be in the form of a mechanical friction clutch or an electrical torque limitation means.

FIG. 2 shows the hand-held power tool 100 from FIG. 1 which, by way of illustration, has a drive unit 220 for rotationally driving an output spindle (310 in FIG. 3), wherein the drive unit 220 can be changed over between a first direction of rotation and a second direction of rotation. The drive unit 220 preferably has a drive motor 120 and an optional switchable transmission 130. The optional switchable transmission 130 preferably has a transmission housing 136 which is formed, by way of illustration, in two parts with a first transmission housing part 137 and a second transmission housing part 138. In this case, the first transmission housing part 137 is preferably arranged facing the drive motor 120 and the second transmission housing part 138 is arranged facing the tool holder 190. However, the transmission housing 136 may also be formed in one part or may have more than two transmission housing parts. The optional switchable transmission 130 is preferably in the form of a planetary transmission which can preferably be changed over at least between two different gears and is described further in FIG. 3.

According to one embodiment, the optional switchable transmission 130 is assigned a gear changeover unit 210 which is designed to change over the optional switchable transmission 130 between the at least two different gears. This gear changeover unit 210 preferably has at least one actuatable switching ring 140. The gear changeover unit 210 also preferably has a transmission unit 134.

The transmission unit 134 is preferably designed to transmit an actuation of the actuatable switching ring 140 to a preferably axially displaceable switching element (350 in FIG. 3) of the transmission 130. The gear changeover unit 210 or the switching element (350 in FIG. 3) preferably changes over the gear only during operation of the optional switchable transmission 130, with the result that it is possible to change over a gear only during operation of the optional switchable transmission 130.

According to one embodiment, at least one operating element (106 in FIG. 1) is provided for the purpose of initiating a changeover operation for changing over the drive unit 220 between the first direction of rotation and the second direction of rotation. The operating element 106 is preferably in the form of a monostable switching element, for example in the form of a switching rocker (406 in FIG. 4), a slide (706 in FIG. 8) and/or a pushbutton (1235 in FIG. 14).

The at least one operating element 106 is preferably assigned a direction of rotation detection unit 160 which is designed to detect a respectively current direction of rotation of the drive unit 220. The direction of rotation detection unit 160 indicates a request to initiate a changeover operation for changing over the drive unit (220 in FIG. 15) between the first direction of rotation and the second direction of rotation, preferably when predefined operating conditions occur, for example in the case of so-called jamming of a drill used as an insertion tool.

Figure 15:
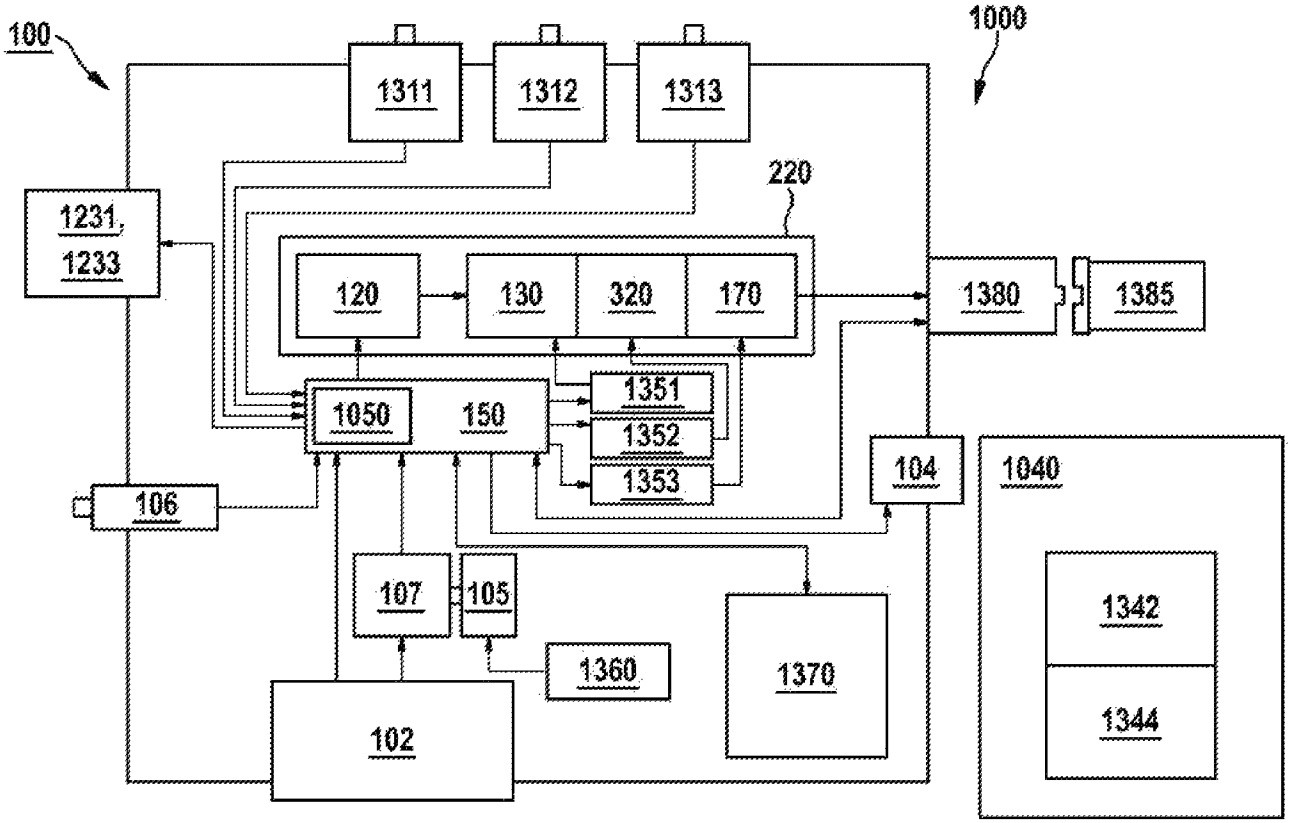
FIG. 15 shows a schematic diagram of the hand-held power tool from FIG. 1 with the exemplary operating element and the communication interface.

According to one embodiment, the operating element (106 in FIG. 1) is assigned a sensor unit (1370 in FIG. 15). The sensor unit 1370 preferably has a mechanical, electrical, magnetic and/or optical sensor and is preferably designed to generate a corresponding actuation signal when the operating element is actuated. The sensor unit 1370 is preferably designed to transmit the actuation signal to a communication interface (1050 in FIG. 1) when the at least one operating element 106 is actuated. The actuation signal can preferably be evaluated in order to determine a respectively current direction of rotation of the output spindle (310 in FIG. 3).

Control electronics 150 are preferably provided and are designed to cause a changeover operation for changing over the drive motor 120 between the first direction of rotation and the second direction of rotation when the at least one operating element (106 in FIG. 1) in the form of a monostable switching element is actuated. The control electronics 150 are preferably designed to cause the changeover operation for changing over the drive motor 120 between the first direction of rotation and the second direction of rotation solely when the drive motor 120 is at a standstill. In addition, the control electronics 150 are preferably designed to cause braking of the drive motor 120 to a standstill in order to enable the changeover operation for changing over the drive motor 120 between the first direction of rotation and the second direction of rotation.

According to one embodiment, the direction of rotation is reversed between the first direction of rotation and the second direction of rotation by an actuating unit 180 with an actuating motor 182. The actuating motor 182 is preferably assigned an actuating motor transmission 184. The actuating motor 182 is preferably designed to cause a changeover operation for changing over the drive unit 220 between the first direction of rotation and the second direction of rotation when activated by the operating element (106 in FIG. 1).

The communication interface 1050 is preferably designed to transmit a control signal for activating the actuating unit 180 to the actuating motor 182. In this case, the control signal can be generated in response to actuation of the at least one operating element 116, 117 from FIG. 1. Alternatively or additionally, the generation of the control signal can preferably be initiated by the user guidance unit 115, that is to say, for example, by a mobile computer in the form of a smartphone, a tablet computer or another so-called "smart device", for example a watch, glasses etc., with the result that it is also possible to dispense with providing the operating elements 106, 116, 117 from FIG. 1. According to one embodiment, the generation can also be directly initiated by the communication interface 1050, for example on the basis of predefined operating parameters, with the result that it is again possible to dispense with providing the operating elements 106, 116, 117.

FIG. 2 also illustrates the manual switch 105 of the hand-held power tool 100, which switch is designed to activate and deactivate the drive motor 120. The manual switch 105 is preferably assigned on on/off switch 107 in this case, wherein the manual switch 105 is preferably in the form of a press button, but may also be in the form of a pushbutton, which is sometimes also referred to as a button.

Figure 3:
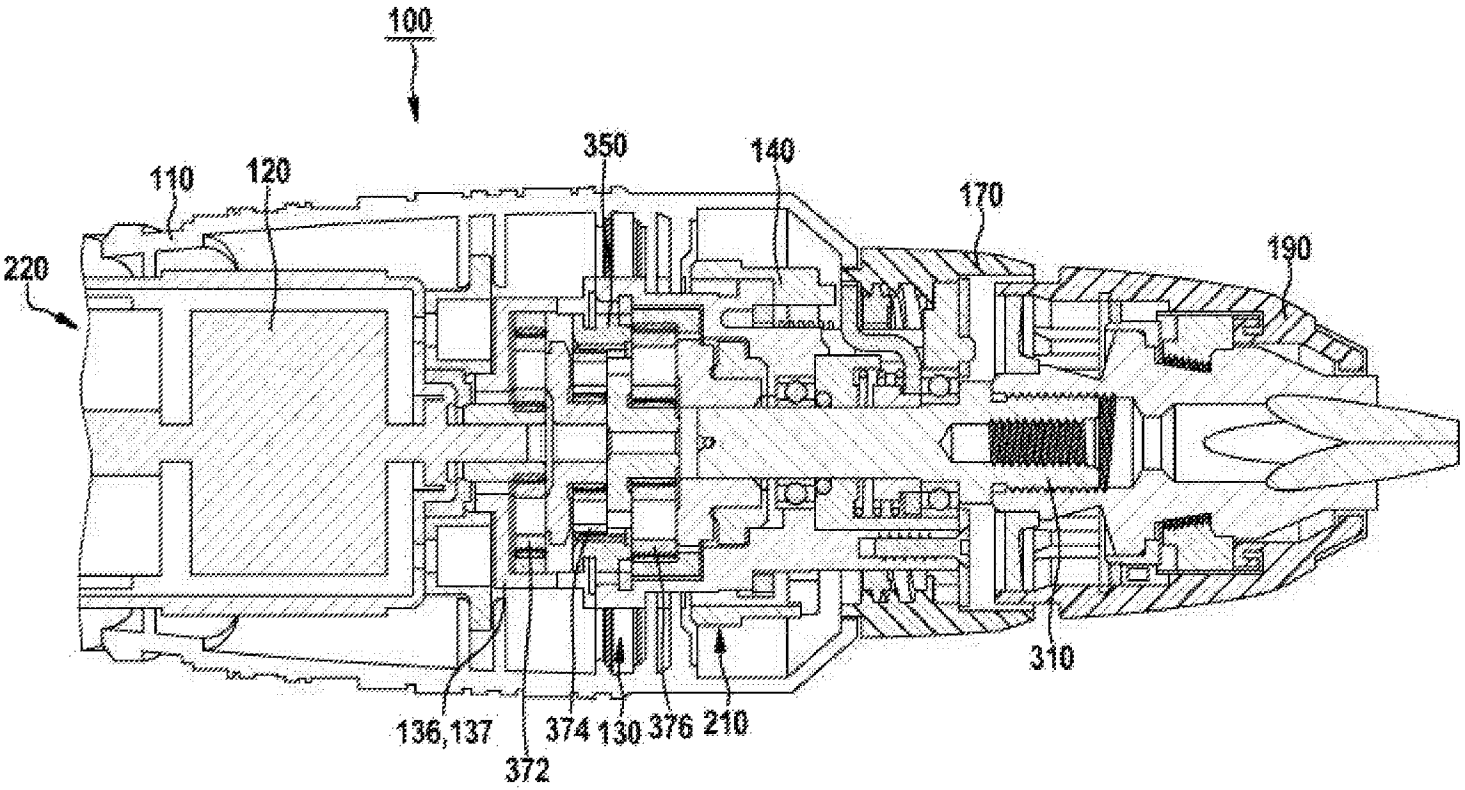
FIG. 3 shows a longitudinal section of the drive unit of the hand-held power tool from FIG. 1 and FIG. 2.

FIG. 3 shows the optional switchable transmission 130 from FIG. 2, which is preferably in the form of a planetary transmission and is intended to drive an output spindle 310 of the hand-held power tool 100 from FIG. 1, and an optional percussion mechanism 320. A suitable structure and the method of operation of a corresponding percussion mechanism are sufficiently well known from the prior art, with the result that a detailed description of the optional percussion mechanism 320 can be dispensed with here for the purpose of simplicity and conciseness of the description.

The planetary transmission 130 preferably has at least a first and a second planetary gear, by way of illustration a first, a second and a third planetary gear 372, 374, 376, which, by way of illustration, make it possible to operate the planetary transmission 130 in a first gear and a second gear. In this case, each gear is preferably assigned to a corresponding operating mode, for example a screwing mode, a drilling mode and/or a percussion drilling mode/percussion screwing mode. For example, a screwing mode for carrying a screwing operation with torque limitation can be provided in a first gear, whereas a drilling operation and/or a drilling and/or screwing operation with a percussion function is/are provided for performance in a second gear.

FIG. 3 also illustrates the fact that a changeover operation for changing over the drive unit 220 for driving the output spindle 310 from the first direction of rotation to the second direction of rotation can be enabled, for example, by changing over the drive motor 120. However, it is pointed out that the configuration of the changeover operation by changing over the drive motor 120 has only an exemplary character and cannot be considered a restriction of the disclosure.

Figure 4:
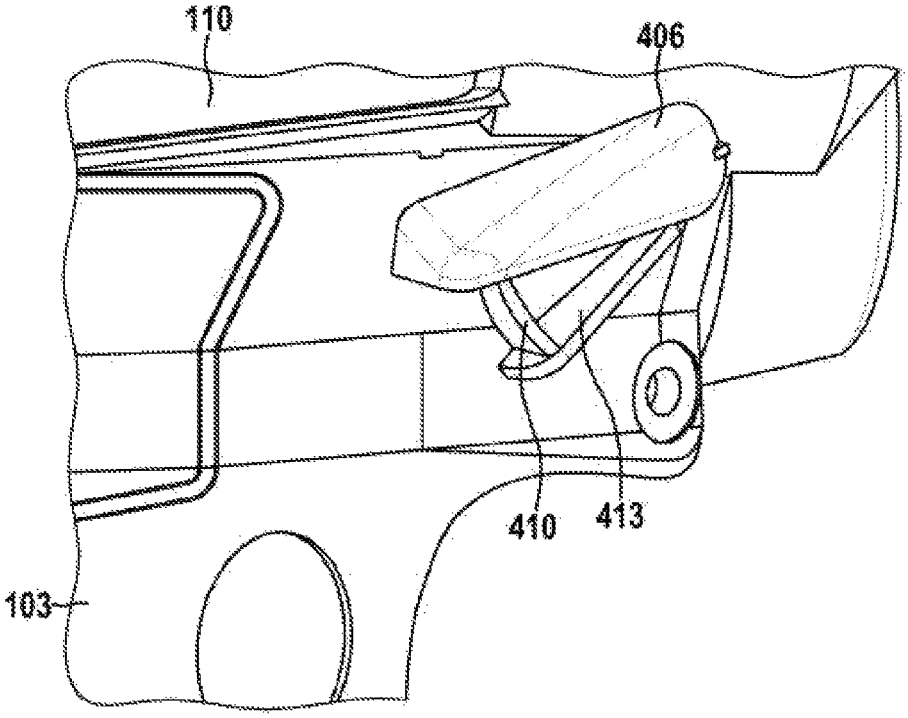
FIG. 4 shows a perspective side view of the operating element from FIG. 1 with a switching rocker according to one embodiment.

FIG. 4 shows, by way of example, an operating element for initiating a changeover operation for changing over the drive unit (220 in FIG. 2) between the first direction of rotation and the second direction of rotation, which operating element is in the form of a switching rocker 406. The switching rocker 406 is preferably fitted above the handle 103 in order to enable easily accessible operation.

The switching rocker 406 is preferably a monostable switch which is moved along a guiding web 410. The switching rocker 406 is preferably in an—upper (by way of illustration in FIG. 4)—position of rest (510 in FIG. 5), wherein actuation of the switching rocker 406 results in rotation into a switching position (520 in FIG. 5), from which the switching rocker 406 preferably independently returns to the position of rest 510. For this purpose, the switching rocker 406 is preferably assigned at least one spring element (610 in FIG. 6) which impinges the switching rocker 406 into the position of rest 510.

Figure 5:
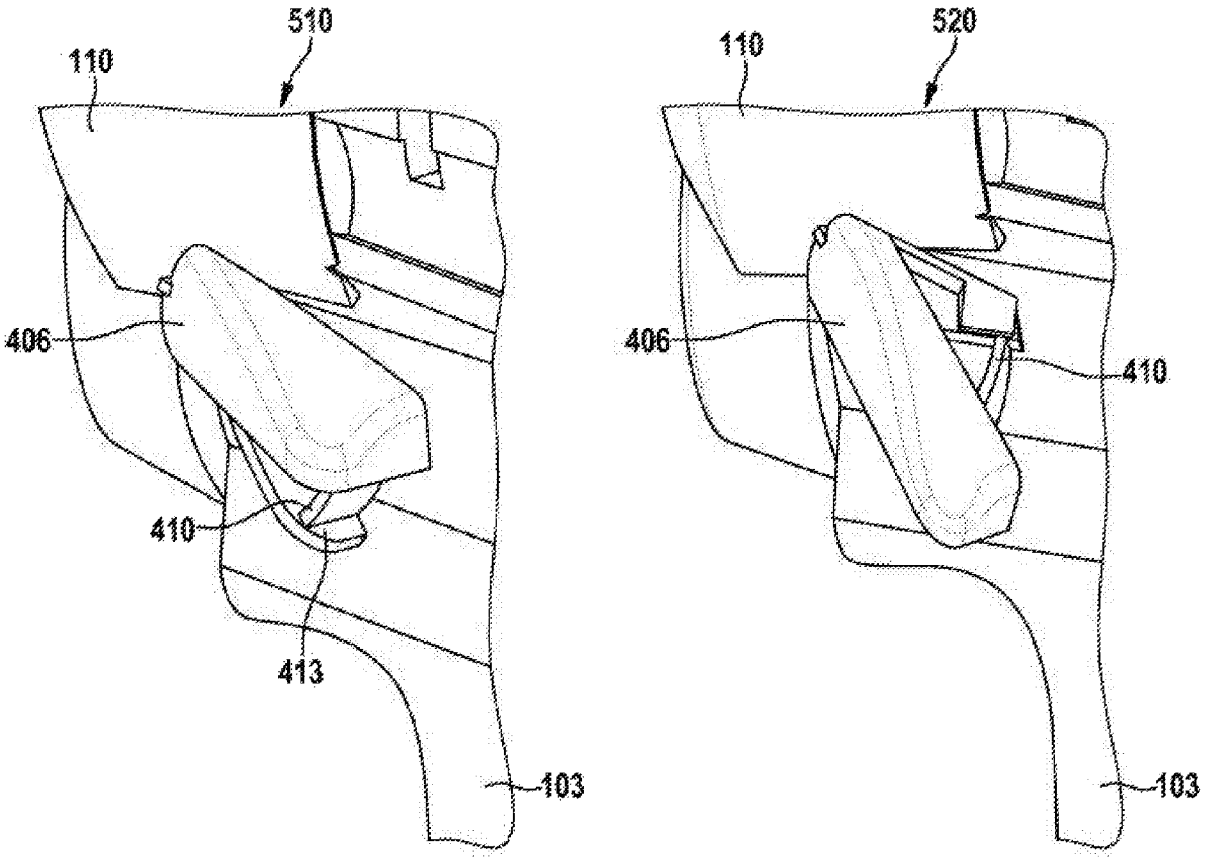
FIG. 5 shows a perspective side view of the switching rocker from FIG. 4 in a stable position of rest and in an unstable switching position.

FIG. 5 shows the switching rocker 406 from FIG. 4 in the position of rest 510 and in the switching position 520. When the switching rocker 406 is actuated, it is preferably rotated from the position of rest 510 into the switching position 520 along the guiding web 410. In this case, the switching rocker 406 is preferably assigned a sensor unit (1370 in FIG. 15) which is designed to generate a corresponding actuation signal when the switching rocker 406 is actuated. The actuation signal can preferably be evaluated in order to determine a respectively current direction of rotation of the output spindle (310 in FIG. 3). For this purpose, the sensor unit 1370 preferably has a mechanical, electrical, magnetic and/or optical sensor. For example, the switching rocker 406 can generate a corresponding actuation signal in the sensor unit 1370 via a lever (408 in FIG. 6).

Figure 6:
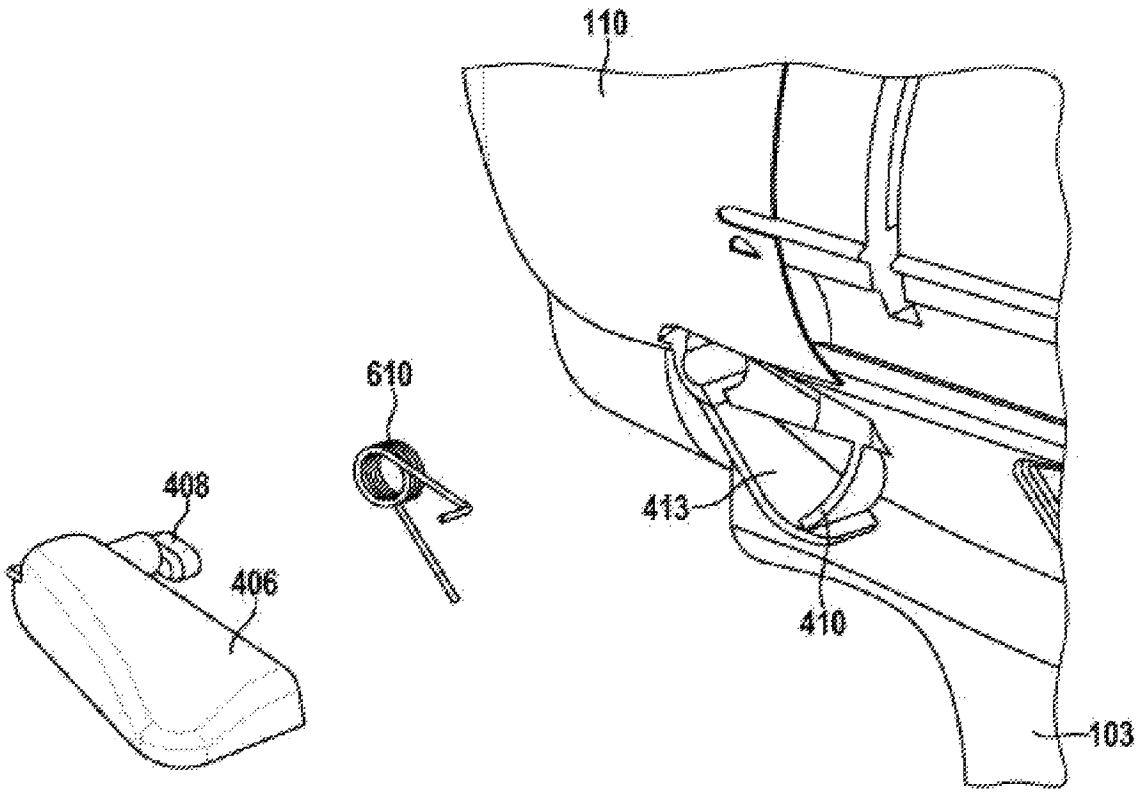
FIG. 6 shows a partially exploded view of the switching rocker from FIG. 4 and FIG. 5.

FIG. 6 shows the switching rocker 406 from FIG. 4 and FIG. 5 which is preferably assigned a spring element 610 which is preferably arranged between the switching rocker 406 and a stop 413. In this case, the spring element 610 is preferably relaxed in the position of rest (510 in FIG. 5) and is tensioned in the switching position (520 in FIG. 5), with the result that the switching rocker 406 can independently return to the position of rest 510 again from the switching position 520 with the aid of the spring element 610.

In the switching position (520 in FIG. 5), the lever 408 is preferably likewise displaced downward owing to the rotation of the switching rocker 406—downward in FIG. 6—along the guiding web 410. In this case, the lever 408 can preferably act on or interact with a mechanical, electrical, magnetic and/or optical sensor of the sensor unit (1370 in FIG. 15). For example, a pushbutton (1235 in FIG. 14) can be fitted below the lever 408, which pushbutton is mechanically actuated by the lever 408 and transmits an electrical signal to control electronics (150 in FIG. 2). The control electronics 150 then preferably cause a changeover operation for changing over the drive unit (220 in FIG. 2) between the first direction of rotation and the second direction of rotation.

Figure 7:
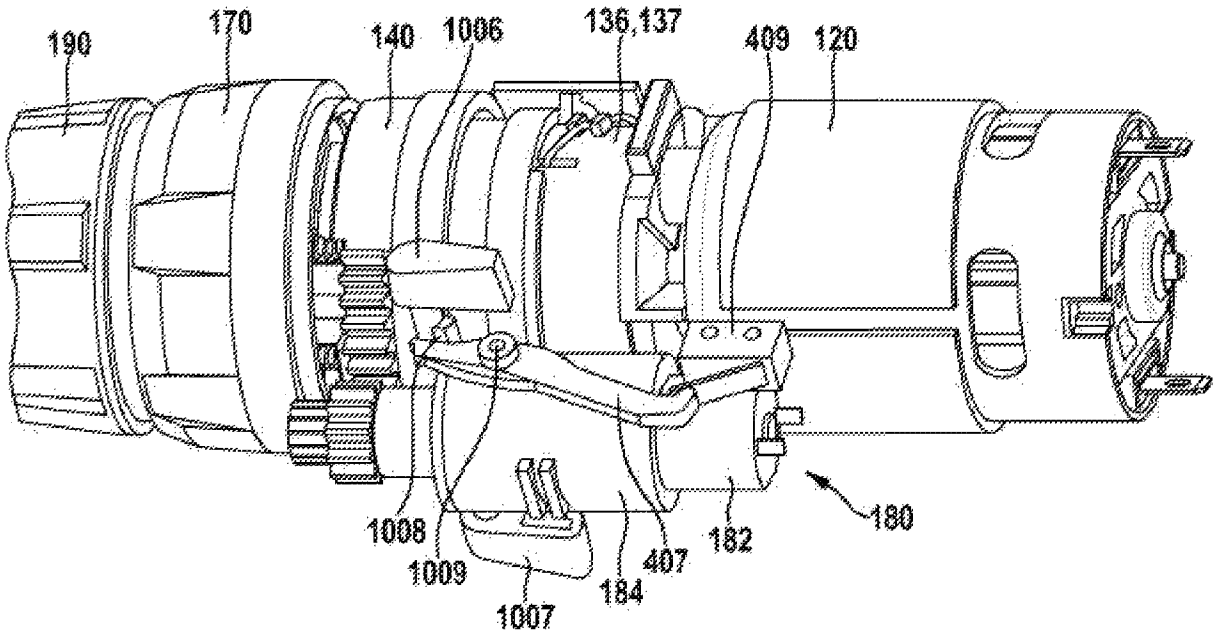
FIG. 7 shows a perspective side view of the operating element from FIG. 1 with two switching rockers according to one embodiment.

FIG. 7 shows an exemplary operating element for initiating a changeover operation for changing over the drive unit (220 in FIG. 2) between the first direction of rotation and the second direction of rotation, which operating element is in the form of two switching rockers 1006, 1007 by way of illustration, wherein one of the two switching rockers 1006, 1007 is respectively preferably provided on one side of the handle (103 in FIG. 1). The two switching rockers 1006, 1007 are each preferably in the form of a monostable switching element and have, by way of illustration, a position of rest (510 in FIG. 5) and a switching position (520 in FIG. 5).

The two switching rockers 1006, 1007 are preferably mechanically decoupled, but may also be optionally connected to one another via a shaft. At least one of the two switching rockers 1006, 1007 is preferably assigned a sensor unit (1370 in FIG. 15) which is designed to generate a corresponding actuation signal when the switching rocker 1006, 1007 is actuated. The actuation signal can preferably be used to set a respectively desired direction of rotation of the output spindle (310 in FIG. 3). For this purpose, the sensor unit 1370 preferably has a mechanical, electrical, magnetic and/or optical sensor. By way of illustration, the switching rocker 1006 can generate a corresponding actuation signal in the sensor unit 1370 when actuated via a lever 1008.

By way of illustration, the sensor unit 1370 has a lever 407 which, when the switching rocker 1006 is actuated and the lever 1008 is therefore rotated—downward in FIG. 7, is rotated in the anticlockwise direction about a shaft 1009 and in the process actuates an electrical switch 409 of the sensor unit 1370, which switch transmits an electrical signal to the control electronics (150 in FIG. 2). The control electronics 150 then preferably cause a changeover operation for changing over the drive unit (220 in FIG. 2) between the first direction of rotation and the second direction of rotation, for example by changing the commutation of the drive motor 120 from FIG. 2.

The switching rocker 1007 is preferably also provided with a corresponding sensor unit 1370, the electrical switch 409 of which can likewise transmit an electrical signal to the control electronics 150 in the event of actuation, as a result of which the control electronics 150 preferably cause a changeover operation for changing over the drive unit 220 between the first direction of rotation and the second direction of rotation. Alternatively, each of the switching rockers 1006, 1007 can be assigned a separate electrical switch 409 which is respectively actuated by a separate lever 407, wherein the two switches 409 are preferably electrically connected in parallel, with the result that the actuation of one of the two switching rockers 1006, 1007 makes it possible to change over the drive unit 220 between the first direction of rotation and the second direction of rotation.

Figure 8:
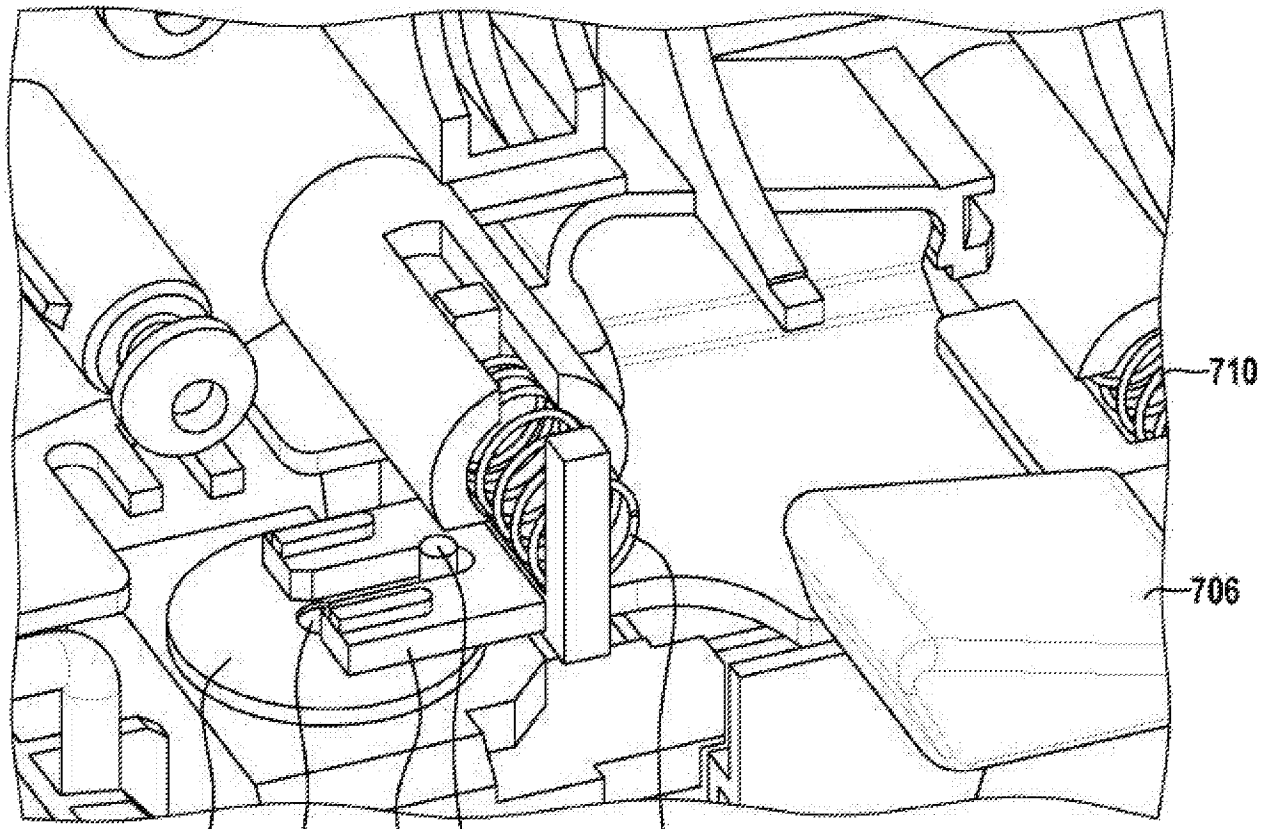
FIG. 8 shows a perspective side view of the operating element from FIG. 1 with a slide according to one embodiment.

FIG. 8 shows an exemplary operating element which is in the form of a monostable switching element and has, by way of illustration, the form of a slide 706. The slide 706 preferably has at least a first spring element, by way of illustration a first spring element 710 and a second spring element 720, which make it possible, for example, for the slide 706 to return to a position of rest from a switching position after the slide has been actuated.

The slide 706 preferably also has a holder 740. This holder 740 is preferably arranged around an entraining element 760 which is preferably permanently connected to the direction of rotation detection unit 160. As a result of the slide 706 being displaced from the position of rest into the switching position, the holder 740 preferably causes a rotational movement of the direction of rotation detection unit 160 about a shaft 762, preferably via the entraining element 760, as a result of which a changeover operation for changing over the drive unit (220 in FIG. 2) between the first direction of rotation and the second direction of rotation is preferably respectively initiated.

Figure 9:
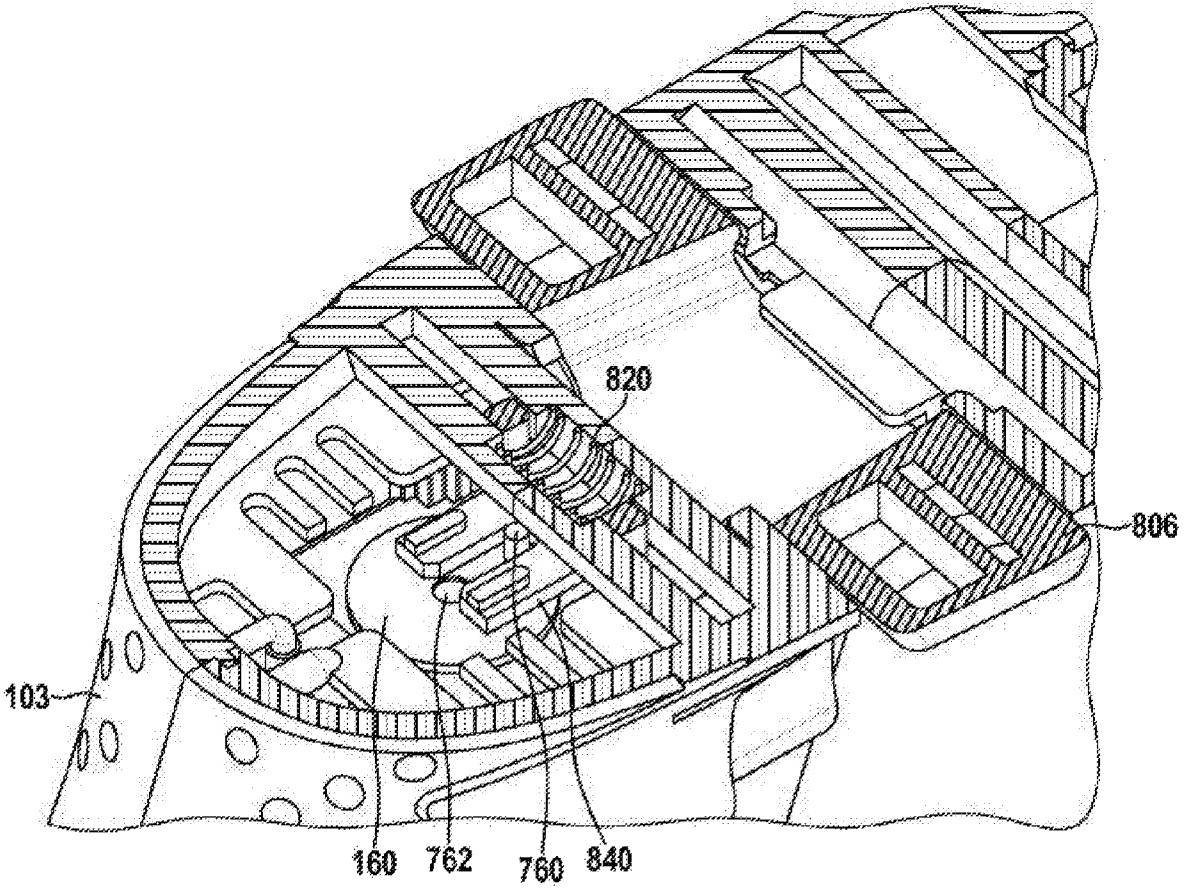
FIG. 9 shows a cross section of a two-sided monostable slide according to one embodiment.

FIG. 9 shows another exemplary operating element for initiating a changeover operation for changing over the drive unit (220 in FIG. 2) between the first direction of rotation and the second direction of rotation, by way of illustration in the form of a two-sided slide 806 which can preferably be actuated from both sides of the handle 103 from FIG. 1. The two-sided slide 806 is preferably in the form of a monostable switching element and has, by way of illustration, a position of rest (920 in FIG. 10) and two switching positions (910, 930 in FIG. 10).

The two-sided slide 806 also preferably has a holder 840. This holder 840 is preferably arranged around an entraining element 760 which is preferably permanently connected to the direction of rotation detection unit 160. As a result of the two-sided slide 806 being displaced from the position of rest (920 in FIG. 10) into one of the two switching positions (910, 930 in FIG. 10), the holder 840 causes a rotational movement of the direction of rotation detection unit 160 in one direction or another about the shaft 762, preferably via the entraining element 760, as a result of which a changeover operation for changing over the drive unit (220 in FIG. 2) between the first direction of rotation and the second direction of rotation is preferably respectively initiated.

The two-sided slide 806 preferably has a spring element 820 which, by way of illustration, makes it possible for the two-sided slide 806 to return to a position of rest (920 in FIG. 10) from one of the two switching positions (910, 930 in FIG. 10) after the slide has been actuated.

Figure 10:
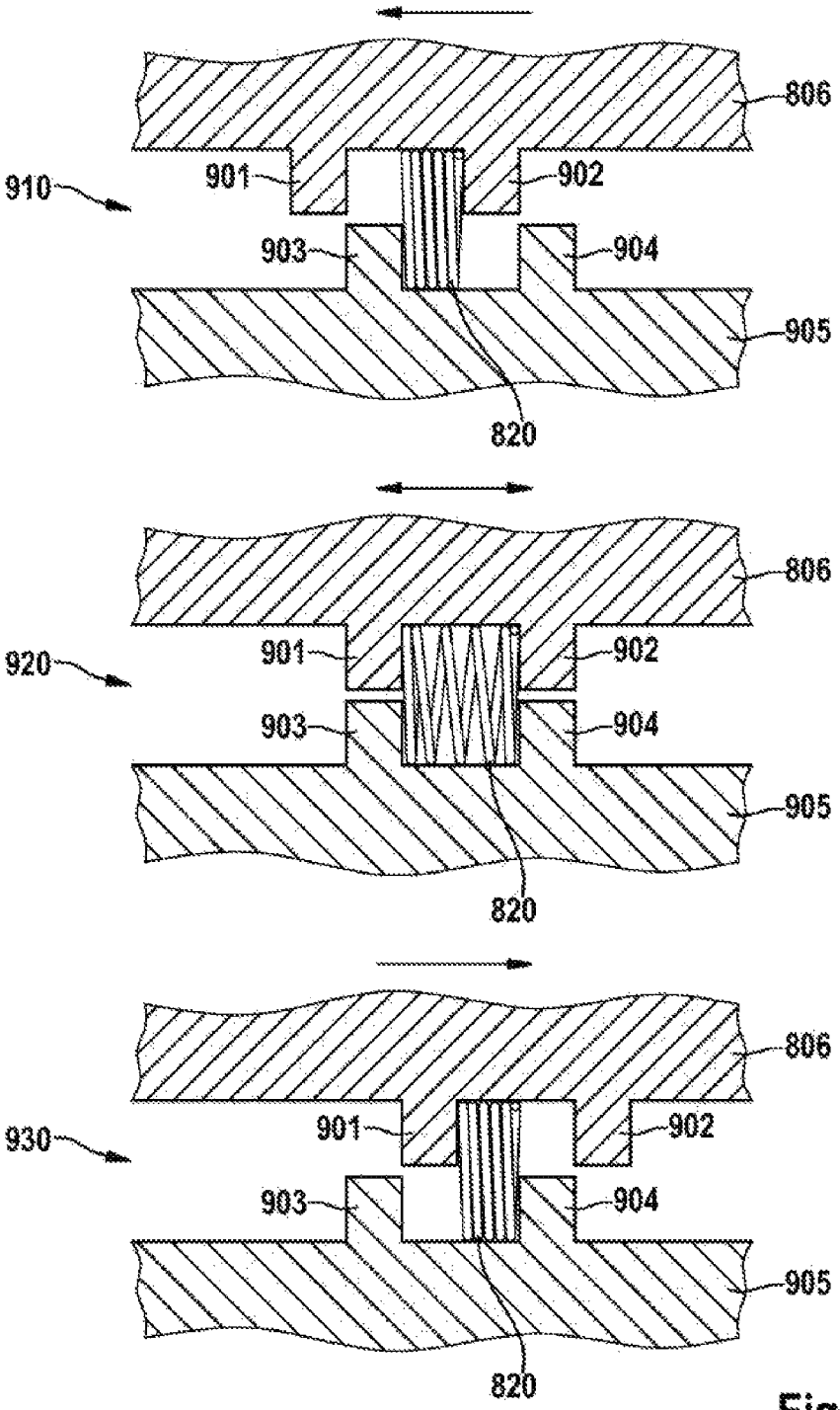
FIG. 10 shows a longitudinal section of the two-sided monostable slide from FIG. 9.

FIG. 10 shows the two-sided slide 806 from FIG. 9 in a position of rest 920 and in two switching positions 910, 930. The two-sided slide 806 preferably has the spring element 820 from FIG. 9. The position of rest 920 is characterized in that the spring element 820 is tensioned at least between a first projection 901 and a second projection 902 of the two-sided slide 806 or between a first projection 903 and a second projection 904 of the housing part 905. By way of illustration, the spring element 820 is tensioned between the first projection 901 and the second projection 902 of the two-sided slide 806 and between the first projection 903 and second projection 904 of the housing part 905. The spring element 820 is preferably relaxed in the position of rest. Alternatively, the spring element 920 can also be arranged in the tensioned form in the position of rest 920.

If the two-sided slide 806 is actuated—from the right-hand side in FIG. 10, the two-sided slide 806 is displaced, by way of illustration, to the left into the first of the two switching positions 910. In this first of the two switching positions 910, the spring element 820 is preferably tensioned between the second projection 902 of the two-sided slide 806 and the first projection 903 of the housing part 905. After the two-sided slide 806 has been actuated, the spring element 820 therefore makes it possible for the two-sided slide 806 to independently return to the position of rest 920 from the switching position 910.

If the two-sided slide 806 is actuated—from the left-hand side in FIG. 10, the two-sided slide 806 is displaced, by way of illustration, to the right into the second of the two switching positions 930. In this second of the two switching positions 930, the spring element 820 is preferably tensioned between the first projection 901 of the two-sided slide 806 and the second projection 904 of the housing part 905. After the two-sided slide 806 has been actuated, the spring element 820 therefore makes it possible for the two-sided slide 806 to independently return to the position of rest 920 from the switching position 930.

Figure 11:
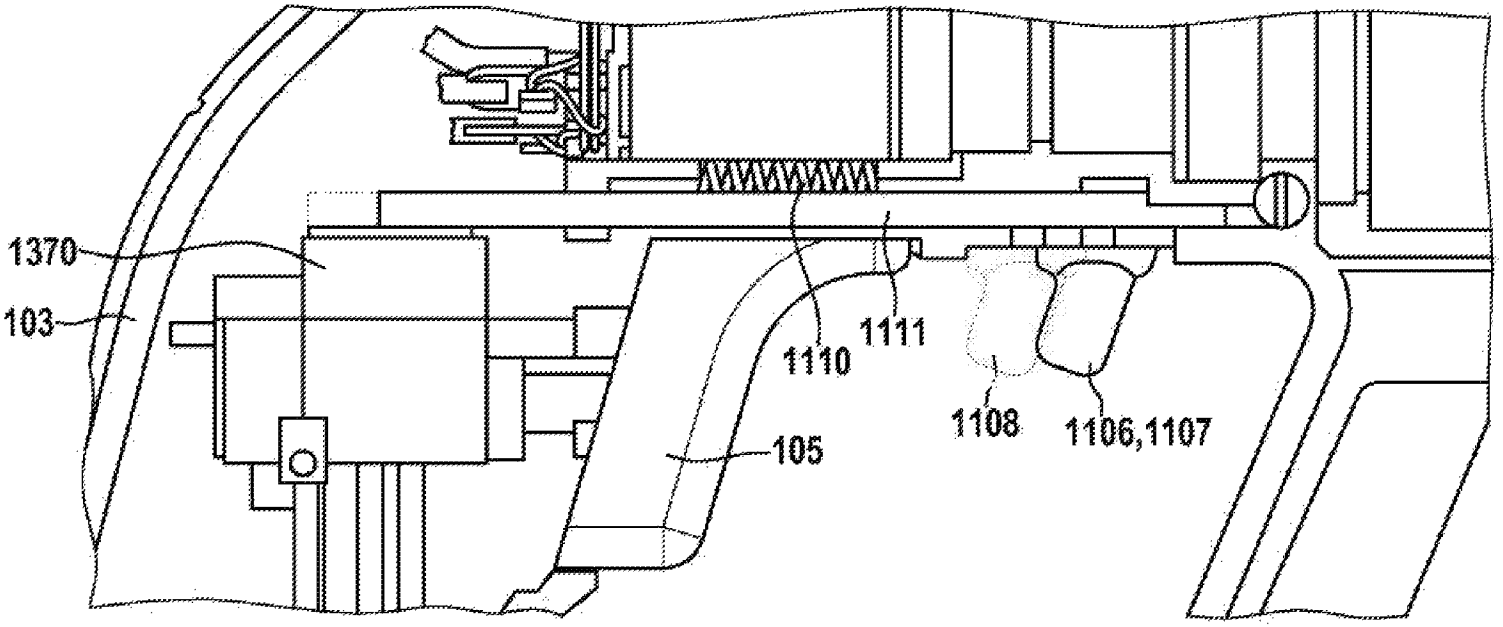
FIG. 11 shows a perspective partial view of the operating element from FIG. 1 according to one embodiment.

FIG. 11 shows another exemplary operating element which is designed as a monostable switching element and is in the form of a slide 1106. By way of illustration, the slide 1106 can be linearly displaced along an associated device longitudinal axis of the hand-held power tool 100 from FIG. 1. By way of illustration, the slide 1106 is in a stable position of rest 1107. If the slide 1106 is actuated, the latter is preferably displaced from the position of rest 1107 into an associated switching position 1108. The slide 1106 is preferably assigned a sensor unit (1370 in FIG. 15) which is designed to generate a corresponding actuation signal when the slide 1106 is actuated. The actuation signal can preferably be evaluated in order to determine a respectively current direction of rotation of the output spindle (310 in FIG. 3). For this purpose, the sensor unit 1370 preferably has a mechanical, electrical, magnetic and/or optical sensor. By way of illustration, the slide 1106 can generate a corresponding actuation signal in the sensor unit 1370 when actuated via a pressure piece 1111.

The stable position of rest 1107 of the slide 1106 is preferably the front position and the unstable switching position is preferably the rear position. Alternatively, the rear position can also be the stable position of rest and the front position can be the unstable switching position. According to one embodiment, the slide 1106 has a position of rest and two switching positions, wherein the first of the two switching positions is provided upstream of the position of rest and the second of the two switching positions is provided downstream of the position of rest. The slide 1106 preferably has at least one spring element 1110 which, by way of illustration, makes it possible for the slide 1106 to return to a position of rest 1107 from a switching position 1108 after the slide has been actuated.

Figure 12:
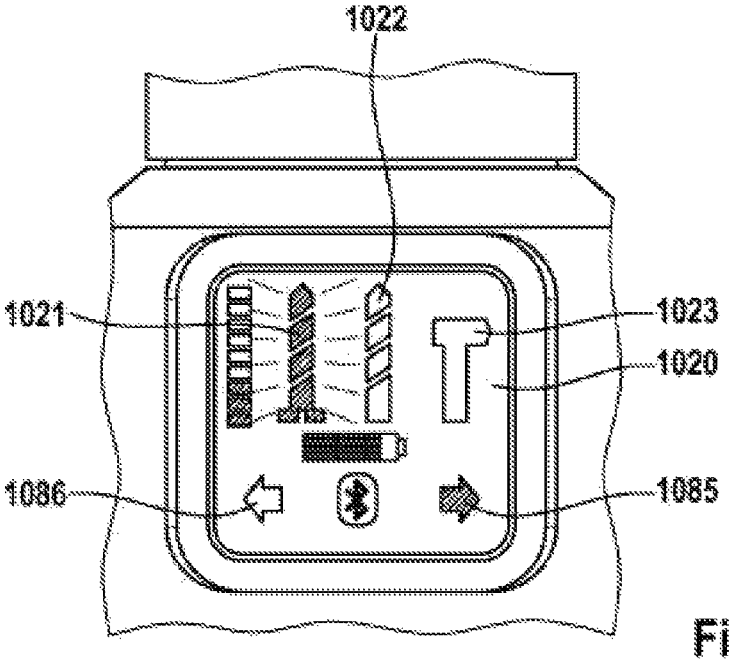
FIG. 12 shows a perspective partial view of the operating element from FIG. 1 with a pushbutton according to one embodiment.

FIG. 12 shows the hand-held power tool 100 from FIG. 1 with the user guidance unit 115 from FIG. 1 which here preferably has an operating unit 1020 for manually setting a gear or an operating mode and/or a direction of rotation. The operating unit 1020 is preferably provided with at least one operating element, by way of illustration three operating elements 1021, 1022, 1023, for setting a gear or an operating mode and with, by way of illustration, two operating elements 1085, 1086 for initiating a changeover operation for changing over the drive unit (220 in FIG. 2) between the first direction of rotation and the second direction of rotation. By way of illustration, the operating element 1021 is provided for the purpose of setting the screwing mode, the operating element 1022 is provided for the purpose of setting the drilling mode and the operating element 1023 is provided for the purpose of setting the percussion mode, wherein the operating elements 1021-1023 have, by way of example, symbols or pictograms corresponding to the operating modes.

By way of illustration, the operating element 1085 is provided for the purpose of setting a rotation of the drive unit 220 in the clockwise direction and the operating element 1086 is provided for the purpose of setting a rotation of the drive unit 220 in the anticlockwise direction. The operating elements 1085, 1086 are each preferably in the form of monostable switching elements and have, for example, symbols or pictograms corresponding to the direction of rotation. The operating elements 1021-1023 and 1085, 1086 are preferably arranged on a printed circuit board 1030. In this case, the operating unit 1020 is preferably at least partially integrated in the hand-held power tool 100.

Figure 13:
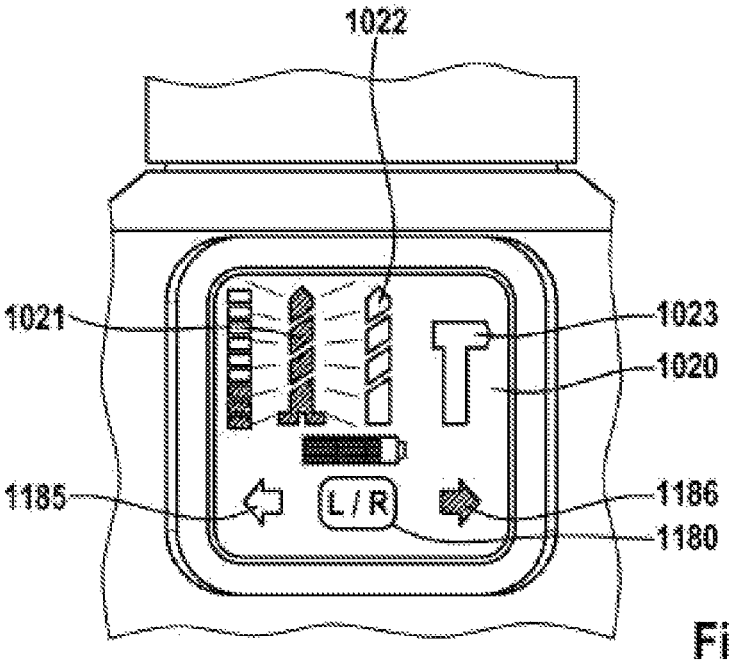
FIG. 13 shows a perspective partial view of the operating element from FIG. 1 according to one embodiment.

FIG. 13 shows an operating unit 1120 having at least one operating element, by way of illustration three operating elements 1021, 1022, 1023, for setting a gear or an operating mode and having, by way of illustration, an operating element 1180 for initiating a changeover operation for changing over the drive unit (220 in FIG. 2) between the first direction of rotation and the second direction of rotation. According to one embodiment, the operating unit 1120 has a touch-sensitive screen.

By way of illustration, the operating element 1021 is provided for the purpose of setting the screwing mode, the operating element 1022 is provided for the purpose of setting the drilling mode and the operating element 1023 is provided for the purpose of setting the percussion mode, wherein the operating elements 1021-1023 have, for example, symbols or pictograms corresponding to the operating modes. By way of illustration, the operating element 1180 is provided for the purpose of changing over the drive unit (220 in FIG. 2) between a first direction of rotation and a second direction of rotation and is preferably in the form of a monostable switching element. The indications 1185, 1186 have, for example, symbols or pictograms corresponding to the direction of rotation. The operating elements 1021-1023 and 1180 are preferably arranged on a printed circuit board 1030. In this case, the operating unit 1020 is preferably at least partially integrated in the hand-held power tool 100 from FIG. 1.

Figure 14:
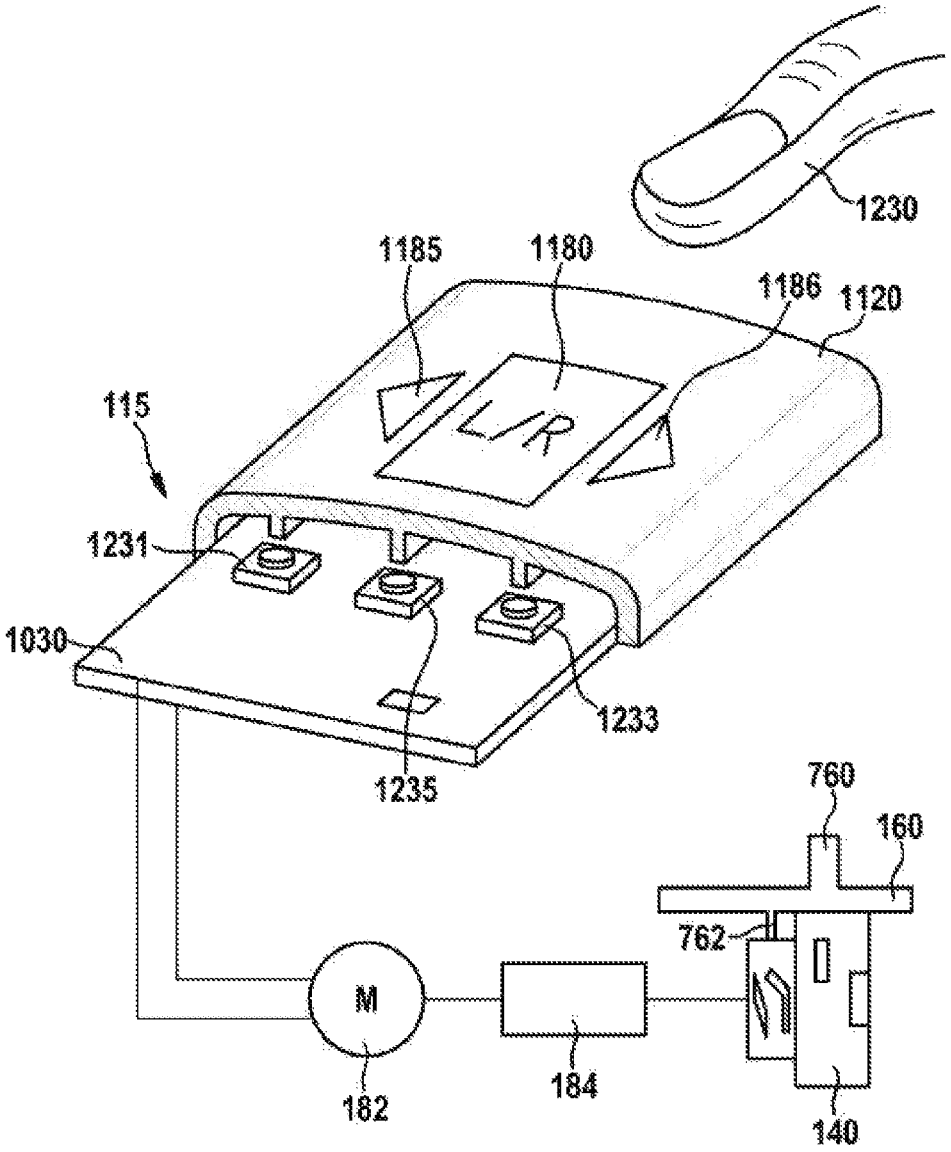
FIG. 14 shows a perspective partial view of the operating element from FIG. 13.

FIG. 14 shows a section of the operating unit 1120 from FIG. 13 with the operating element 1180 and the printed circuit board 1030. At least two indications 1185, 1186 are preferably provided on the operating unit 1120 for the purpose of indicating a respectively set direction of rotation. The indication 1185 preferably indicates a rotation of the output spindle (310 in FIG. 3) in the anticlockwise direction and the indication 1186 indicates a rotation of the output spindle 310 in the clockwise direction.

The printed circuit board 1030 preferably has at least one switching element 1235 assigned to the operating element 1180 and at least two illumination means 1231, 1233 assigned to the indications 1185, 1186. The illumination means 1231, 1233 are preferably at least designed to indicate a request to initiate a changeover operation for changing over the drive unit 220 between the first direction of rotation and the second direction of rotation when predefined operating conditions occur.

The switching element 1235 is preferably in the form of a monostable switch, by way of illustration in the form of a pushbutton, and/or the illumination means 1231, 1233 are in the form of LEDs. Alternatively or additionally, the operating unit 1120 can also be in the form of a display, preferably with a touch-sensitive screen, which is sometimes also referred to as a touchscreen, and/or a mobile computer, wherein a symbol to be respectively actuated can respectively light up and/or flash on the display. Alternatively, it is also possible to implement gesture recognition. The operating unit 1120 is preferably connected to the actuating motor 182 and to the actuating motor transmission 184 for the purpose of setting a direction of rotation selected by a user 1230, which can in turn preferably rotate the direction of rotation detection unit 160 about a shaft 762.

FIG. 15 shows a schematic tool system 1000 having the hand-held power tool 100 described above and a mobile computer 1040. In this case, FIG. 15 illustrates the hand-held power tool 100 with its drive unit 220 having the drive motor 120, the transmission 130, the optional percussion mechanism 320 and the torque limitation element 170. In this case, the control electronics 150 control at least one actuator 1351, 1352, and 1353. By way of illustration, FIG. 15 illustrates three actuators 1351, 1352, 1353, wherein the actuator 1351, for example, is designed to change over the gear of the transmission 130 and/or to change over the transmission 130 between the first direction of rotation and the second direction of rotation, the actuator 1352 is designed to activate/deactivate the optional percussion mechanism 320 and the actuator 1353 is designed to set a torque by means of the torque limitation element 170. The control electronics 150 preferably forward an activation signal to an assigned illumination means 1231, 1233 when an actuator 1351-1353 is activated. Alternatively or additionally, the activation signal may also be in the form of a signal tone.

According to one embodiment, the mobile computer 1040 has an interactive program 1342, 1344, in particular a smartphone app, for communicating with the communication interface 1050 of the hand-held power tool 100. In this case, a first program 1342 is preferably designed to set applications, for example in order to screw a screw into softwood. In this case, the program 1342 determines operating parameters, for example a speed, a direction of rotation, a torque, a gear and/or a percussion operation requirement, preferably for a respective application, and forwards said parameters to the communication interface 1050 of the hand-held power tool 100.

Alternatively, the interactive program 1342, 1344 may also be assigned only to the communication interface 1050 of the hand-held power tool 100. In this case, the interactive program 1342, 1344 is preferably executed by the communication interface 1050 of the hand-held power tool 100, with the result that it is possible to dispense with use of the mobile computer 1040.

In this case, the communication interface 1050 is preferably designed to transmit a control signal to the actuators 1351, 1352, 1353 of the hand-held power tool 100, wherein at least one actuator 1351 is designed to change over the transmission 130 between the different gears when activated by the communication interface 1050.

In this case, the communication interface 1050 preferably transmits the control signal to the control electronics 150 which activate and/or control the respective actuators 1351-1353.

Alternatively or additionally, a second program 1344 is provided and is designed to set at least one particular operating parameter, for example a speed, a direction of rotation, a torque, a gear and/or a percussion operation requirement. In this case, a user of the hand-held power tool 100 inputs desired operating parameters directly via the program 1344. These parameters are then transmitted to the communication interface 1050 of the hand-held power tool 100, wherein the communication interface 1050 forwards a corresponding control signal, as described above.

Alternatively or additionally, the hand-held power tool 100 can have at least one operating element 106, 1311, 1312, 1313 for the purpose of initiating a changeover operation for changing over the drive unit (220 from FIG. 2) or the drive motor 120 or the transmission 130 between the first direction of rotation and the second direction of rotation, for the purpose of manually setting a gear and/or an operating mode or for the purpose of manually setting operating parameters. By way of illustration, FIG. 15 shows four operating elements 106, 1311, 1312, 1313. In this case, the first operating element 106, for example, is designed to initiate the changeover operation for changing over the drive unit 220 between the first direction of rotation and the second direction of rotation, the second operating element 1311 is designed to change over the gear, the third operating element 1312 is designed to activate and/or deactivate the optional percussion mechanism 320 and the fourth operating element 1313 is designed to set the torque.

The respective operating element 106, 1311, 1312, 1313 is preferably designed to transmit a control signal to the control electronics 150 in an application-specific manner or depending on the input, with the result that the control electronics 150 can directly activate and/or control the respective actuators 1351-1353 and/or the drive motor 120. In this case, the operating element 106 is preferably in the form of a monostable switch, for example in the form of a switching rocker (406 in FIG. 4), a slide (706 in FIG. 8) or a pushbutton (1235 in FIG. 14). The operating elements 1311-1313 are preferably in the form of electrical operating elements, but may also be in the form of any other desired operating element, for example in the form of a mechanically displaceable lever arm.

In addition, the user guidance unit 115 may be assigned a display and/or a mobile computer 1040 which indicates changeover instructions for changing over the drive motor (120 in FIG. 2) or the output spindle (310 in FIG. 3), which can be at least indirectly driven by the drive motor, between the first direction of rotation and the second direction of rotation and/or changeover instructions for changing over the drive motor 120 or the transmission 130 in an application-specific manner. In this case, the respective changeover instructions can be visualized on the display and/or the mobile computer 1040 as step-by-step instructions. In this case, the at least one operating element 116, 117 is preferably assigned a sensor unit 1370 which is designed to transmit an actuation signal to the communication interface 1050 and/or to the mobile computer 1040 if the at least one operating element 116, 117 is actuated, with the result that a next step of the respective changeover instruction can be respectively indicated.

Furthermore, the sensor unit 1370 may also be in the form of an internal and/or external sensor for monitoring and/or optimizing the hand-held power tool 100 and may preferably be in the form of a temperature sensor, an acceleration sensor, a position sensor etc. In this case, it is possible to provide software which is designed to check the settings of the control electronics 150 or of the hand-held power tool 100 and to adapt them if necessary, for example to output a warning signal and/or to automatically change over the gear if the drive motor 120 from FIG. 1 has become hot on account of an excessively high applied torque.

An adapter interface 1380 is preferably provided for the purpose of connection to at least one adapter 1385. In this case, the adapter interface 1380 can be in the form of a mechanical interface, an electrical interface and/or a data interface, wherein the adapter 1385 is designed to transmit information and/or control signals, for example a torque, a speed, a voltage, a current and/or further data, to the hand-held power tool 100. The adapter 1385 in an adapter interface 1380 in the form of a data interface preferably has a transmission unit. The adapter 1385 can preferably be in the form of a distance meter, for example, and can pass determined parameters to the hand-held power tool 100 via the adapter interface 1380. In this case, the adapter can be used with and/or without the drive unit 220. The adapter 1385 can preferably be activated via the mobile computer 1040, in which case the latter or the display can visualize activation of the adapter 1385.

The control electronics 150 preferably also control the drive motor 120 and/or the working field illumination 104. The manual switch 105 preferably has a locking mechanism 1360 which is preferably in the form of a mechanical and/or electrical locking mechanism. Furthermore, the on/off switch 107 and/or the control electronics 150 is/are supplied with power by the rechargeable battery pack 102.

FIG. 16 shows the hand-held power tool 100 from FIG. 1 with the drive unit 220 from FIG. 2 which can be changed over between the first direction of rotation and the second direction of rotation, wherein the hand-held power tool 100 according to one embodiment has the switching rocker 406 from FIG. 4 and the communication interface 1050 from FIG. 1. In addition, the hand-held power tool 100 is provided with the user guidance unit 115 from FIG. 1 which here preferably has the operating unit 1120 from FIG. 13 for manually setting a reversal of the direction of rotation.

The operating unit 1120 is preferably provided with at least one operating element 1180 for initiating a changeover operation for changing over the drive unit (220 in FIG. 2) between the first direction of rotation and the second direction of rotation. By way of illustration, the operating element 1180 is provided for the purpose of changing over the drive unit (220 in FIG. 2) between the first direction of rotation and the second direction of rotation and is preferably in the form of a monostable switching element. In this case, the operating unit 1020 is preferably at least partially integrated in the hand-held power tool 100.

In this case or alternatively, the user guidance unit 115 can be at least partially in the form of an external separate component 1040, as described above. In this case, the external component 1040 preferably has a mobile computer, in particular in the form of a smartphone and/or a tablet computer. Alternatively, other so-called "smart devices", for example a watch, glasses etc., can also be used as the mobile computer. In this case, it is also possible to dispense with providing the operating unit 1120, as described above, in particular if the operating unit can be implemented by the mobile computer 1040. In order to indicate an operating mode which has been set, the hand-held power tool 100 preferably has a display. The user guidance unit 115 preferably forms, with the hand-held power tool 100, a tool system 1000 in this case.

The mobile computer 1040 preferably has a display 1010 which is preferably in the form of a touchscreen. The display 1010 preferably has at least one operating element 1015 at least for reversing the direction of rotation of the output spindle (310 in FIG. 3) of the hand-held power tool 100 and at least two indication elements 1014 and 1016 for indicating the currently set direction of rotation. Alternatively or additionally, the at least two indications 1014, 1016 are formed on the display 1010 as operating elements for determining the direction of rotation of the output spindle 310. Furthermore, the display 1010 preferably has at least one operating element, by way of illustration three operating elements 1011, 1012, 1013, for inputting at least one operating mode of the hand-held power tool 100. By way of illustration, the operating elements 1011-1016 are in the form of operating panels on the display 1010 in FIG. 16, but could also be in the form of switches and/or buttons.

According to one embodiment, the hand-held power tool 100 is designed in such a manner that the output spindle 310 from FIG. 3 assumes a preprogrammed first direction of rotation under particular conditions, for example after an interrupted power supply caused by changing a rechargeable battery pack 102. The operating elements 106, 1015, 1180 are preferably designed to make it possible to reprogram the hand-held power tool 100, as a result of which the preprogrammed first direction of rotation is at least reversed. The reprogramming is preferably carried out by actuating the operating elements 106, 1015, 1180 in a predetermined sequence. Actuation of the operating elements 106, 1015, 1180 in another predetermined sequence preferably makes it possible to block the hand-held power tool 100.

In the event of the user guidance unit 115 having both the operating unit 1120 and the mobile computer 1040, the above-described control signal is preferably designed to generate an indication on the display 1010 for requesting the initiation of a changeover operation for changing over the transmission 130 between the different gears and/or to generate an indication for requesting the initiation of a changeover operation for changing over the drive unit (220 in FIG. 2) between the first direction of rotation and the second direction of rotation and/or to make it possible to initiate the changeover operation.

In this case, changeover instructions are preferably indicated using the display 1010, for example an instruction relating to which direction of rotation is intended to be set for a predefined work process, which direction of rotation can then be set by a user of the hand-held power tool 100, for example via the operating unit 1120. In this case, the indications 1185, 1186 on the hand-held power tool 100 can be provided with illumination means (1231, 1233 in FIG. 14) and the control signal is designed in this case to respectively activate a corresponding illumination means 1231, 1233.

In addition, the mobile computer 1040 can also be at least partially integrated in the hand-held power tool 100 and the operating mode is preferably respectively set automatically, preferably via the actuating unit 180. It is pointed out that the exemplary implementations of the user guidance unit 115 which are described in FIG. 16 can be combined with one another as desired and the communication interface 1050, for example, can also undertake the functionality of the user guidance unit 115.

Figure 17:
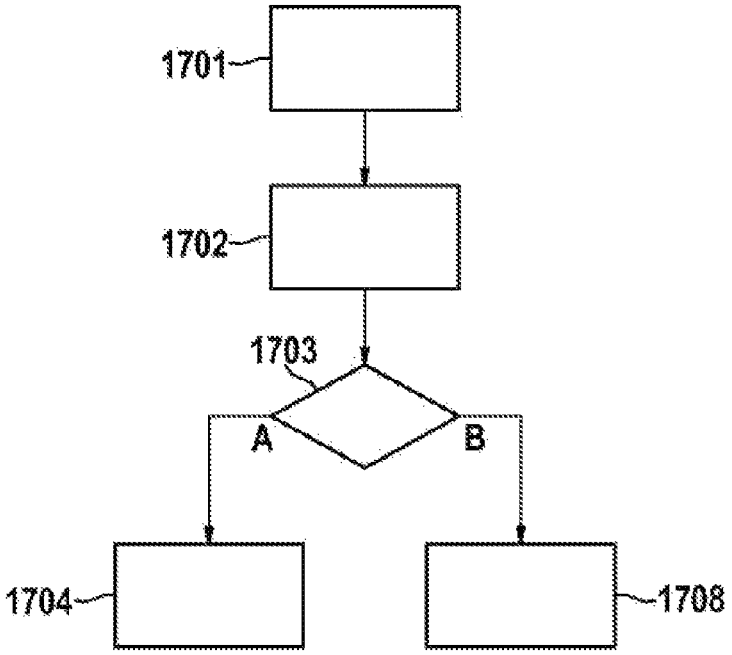
FIG. 17 shows a flowchart of an interactive program for initiating a changeover operation for changing over a drive unit between a first direction of rotation and a second direction of rotation.

FIG. 17 shows a flowchart for initiating a changeover operation for changing over a drive unit (220 in FIG. 2) of a hand-held power tool (100 in FIG. 1) between a first direction of rotation and a second direction of rotation, wherein a user guidance unit (115 in FIG. 1, 1040 in FIG. 16) which can be actuated by a user is provided and is designed to transmit changeover instructions for changing over the drive unit 220 between the first direction of rotation and the second direction of rotation in an application-specific manner to a communication interface (1050 in FIG. 1). In this case, the user guidance unit 115, 1040 is preferably at least partially integrated in the hand-held power tool 115, 100 and/or is at least partially in the form of an external separate component 1040. The user guidance unit 115, 1040 preferably has a mobile computer 1040, in particular a mobile computer in the form of a smartphone or a tablet computer.

Alternatively, other so-called "smart devices", for example a watch, glasses etc., can also be used as the mobile computer.

The user guidance unit 115, 1040 preferably has an interactive program 1342, 1344, in particular a smartphone app, for communicating with the communication interface 1050. Alternatively or additionally, it is possible to interact with the interactive program, preferably via a user guidance unit 115 in the form of an operating element 1120.

The user guidance unit 115, 1040 also preferably has at least one operating element 106 for initiating a changeover operation for changing over the drive unit 220 between the first direction of rotation and the second direction of rotation, wherein the communication interface 1050 is designed to transmit a control signal to the at least one operating element 106 in order to make it possible for the at least one operating element 106 to generate a request to initiate a changeover operation for changing over the drive unit 220 between the first direction of rotation and the second direction of rotation.

The at least one operating element 106 preferably has a display 1010 and the control signal is preferably designed to generate an indication on the display 1010 for visualizing the request to initiate a changeover operation for changing over the drive unit 220 between the first direction of rotation and the second direction of rotation. In this case, the display 1010 is preferably in the form of a touchscreen.

According to one embodiment, an interactive program 1342, 1344 becomes active in step 1701 with establishment of the power supply—for example after the electrical connection of a rechargeable battery pack (102 in FIG. 1) which is in a charged state—with the hand-held power tool 100. Alternatively or additionally, an interactive program 1342, 1344 can be activated by touching the display 1010. After the interactive program 1342, 1344 has been activated, the drive unit 220 preferably assumes a preprogrammed first direction of rotation, preferably a rotation of the drive unit 220 in the clockwise direction.

In step 1702, the interactive program 1342, 1344 identifies a desired changeover operation for changing over the drive unit 220. If the interactive program 1342, 1344 identified a first changeover operation in step 1702, which corresponds to response A to test 1703, the interactive program 1342, 1344 continues with the first changeover operation in step 1704. If the interactive program 1342, 1344 identified a second changeover operation in step 1702, which corresponds to response B to test 1703, the interactive program 1342, 1344 continues with the second changeover operation in step 1708.

Figure 18:
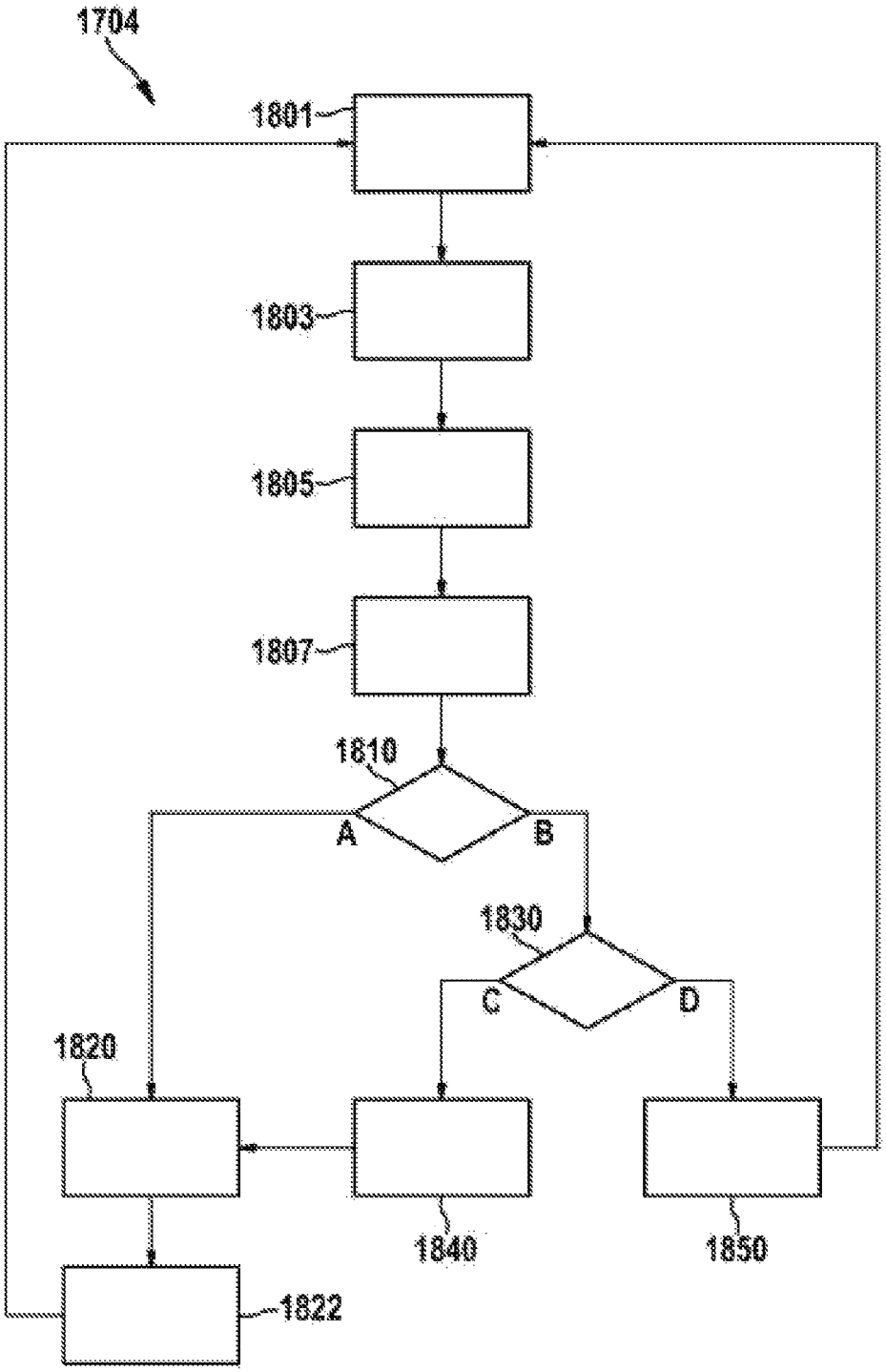
FIG. 18 shows a flowchart of a first changeover operation from FIG. 17.

FIG. 18 shows a flowchart of the first changeover operation 1704 from FIG. 17. In step 1801, the interactive program 1342, 1344 preferably monitors the at least one operating element 106, preferably via the sensor unit 1370 from FIG. 15 which preferably has a mechanical, electrical, magnetic and/or optical sensor. In step 1803, the interactive program 1342, 1344 captures a movement of the operating element 106 from a stable position of rest (510 in FIG. 5) into an unstable switching position (520 in FIG. 5) caused, for example, by the actuation of the operating element 106 by a user (1230 in FIG. 14).

In step 1805, after the operating element 106 has been actuated by the user 1230, the interactive program 1342, 1344 captures a movement of the operating element 106 from the unstable switching position 520 back into the stable position of rest 510, preferably caused by at least one spring element (610 in FIG. 6). In step 1807, the interactive program 1342, 1344 monitors the status of the drive motor 120 and continues with step 1820 if the drive motor 120 is not operating, which corresponds to response A to test 1810. If the drive motor 120 is operating, which corresponds to response B to test 1810, the interactive program 1342, 1344 continues with step 1830.

In test 1830, the interactive program 1342, 1344 tests whether a changeover operation for changing over the drive unit 220 between the first direction of rotation and the second direction of rotation is allowed if the drive motor 120 is operating. If the changeover operation is not allowed (response D), a changeover operation is not carried out in step 1850 and the interactive program 1342, 1344 continues with step 1801. If the changeover operation is allowed, which corresponds to response C to test 1830, the interactive program 1342, 1344 continues with step 1840, during which the drive motor 120 is braked to a standstill.

If the drive motor 120 is not operating or is at a standstill, the interactive program 1342, 1344 causes a changeover operation for changing over the drive unit 220 between the first direction of rotation and the second direction of rotation in step 1820. If the drive unit 220 was driven in the clockwise direction, for example, before step 1820, the drive unit 220 is driven in the anticlockwise direction after step 1820. If the drive unit 220 was driven in the anticlockwise direction, for example, before step 1820, the drive unit 220 is driven in the clockwise direction after step 1820. Furthermore, the interactive program 1342, 1344 in step 1820 preferably controls an indication—for example indication 1014, 1016 on the display 1010 in FIG. 16 and/or indication 1185, 1185 on operating unit 1120 in FIG. 14—for indicating the current direction of rotation of the output spindle 310 from FIG. 3.

After the changeover operation has been completed, the interactive program 1342, 1344 continues with step 1822, during which the interactive program 1342, 1344 preferably makes it possible to activate the drive motor 120 again and returns to step 1801.

Figure 19:
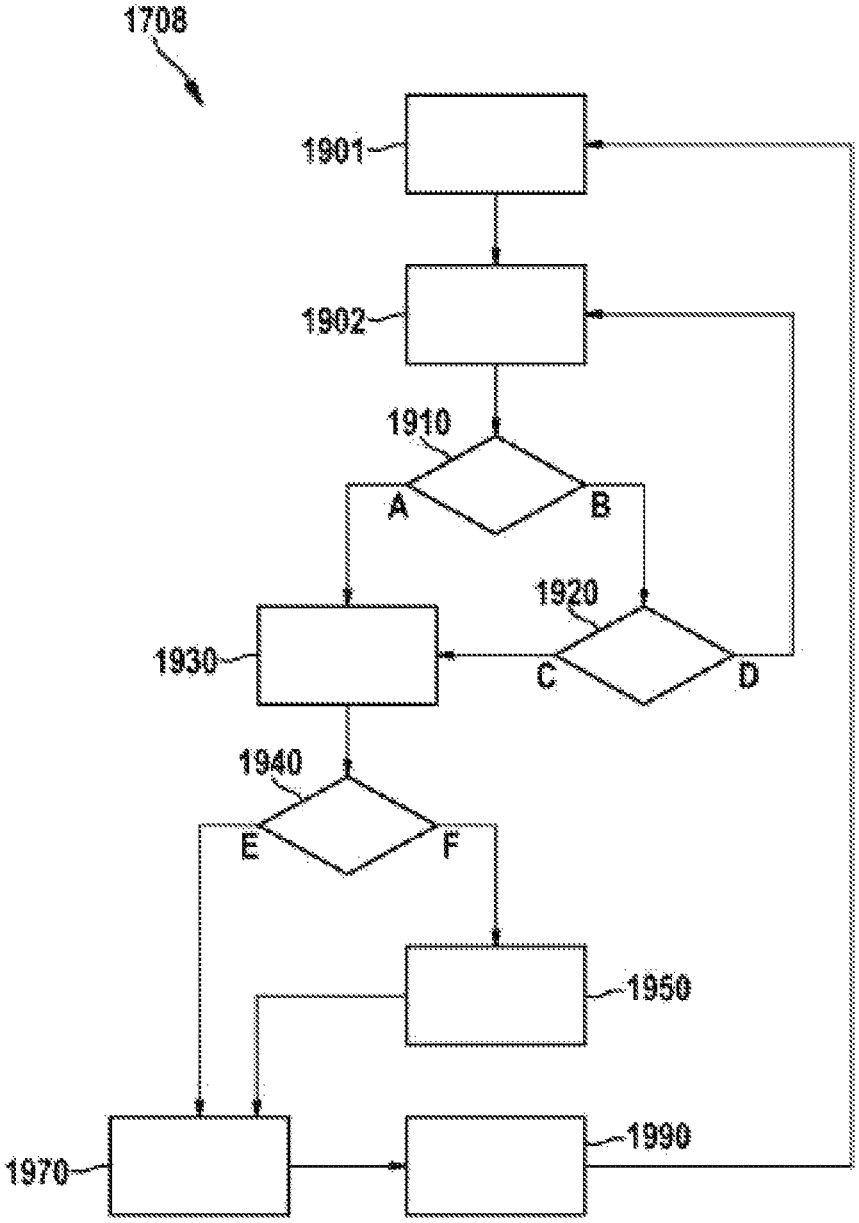
FIG. 19 shows a flowchart of a second changeover operation from FIG. 17.

FIG. 19 shows a flowchart of the second changeover operation 1708 from FIG. 17. In step 1901, the interactive program 1342, 1344 sets a preferred direction of rotation of the drive unit (220 in FIG. 2). The preferred direction of rotation is preset as a rotation in the clockwise direction, for example. Alternatively or additionally, the preferred direction of rotation can be programmed by the user (1230 in FIG. 14).

In step 1902, the interactive program 1342, 1344 preferably monitors the at least one operating element 106, preferably via a sensor unit (1370 in FIG. 15) which preferably has a mechanical, electrical, magnetic and/or optical sensor. If the interactive program 1342, 1344 captures a movement of the operating element 106 from a stable position of rest (510 in FIG. 5) into an unstable switching position (520 in FIG. 5), preferably via the sensor unit 1370, which corresponds to response A to test 1910 and can be carried out, for example, by a user 1230 actuating the operating element 106, the interactive program 1342, 1344 continues with step 1930. If the interactive program 1342, 1344 does not capture a movement of the operating element 106 from a stable position of rest (510 in FIG. 5) into an unstable switching position (520 in FIG. 5), which corresponds to response B to test 1910, the interactive program 1342, 1344 continues with test 1920.

If the interactive program 1342, 1344 captures a movement of the operating element 106 from the unstable switching position 520 back into the stable position of rest 510, preferably via the sensor unit 1370, which corresponds to response C to test 1920 and is preferably enabled by means of at least one spring element (610 in FIG. 6), the interactive program 1342, 1344 continues with step 1930. If the interactive program 1342, 1344 does not capture a movement of the operating element 106 from an unstable switching position 520 into a stable position of rest 510, which corresponds to response D to test 1920, the interactive program 1342, 1344 returns to step 1902.

In step 1930, the interactive program 1342, 1344 monitors the status of the drive motor 120 and continues with test 1960 if the drive motor 120 is not operating, which corresponds to response E to test 1940. If the drive motor 120 is operating, which corresponds to response F to test 1940, the interactive program 1342, 1344 continues with step 1950.

In step 1950, the interactive program 1342, 1344 preferably causes braking of the drive motor 120 to a standstill. If the drive motor 120 is not operating or is at a standstill, the interactive program causes a changeover operation for changing over the drive unit 220 between the first direction of rotation and the second direction of rotation in step 1970. If the drive unit 220 was driven in the clockwise direction, for example, before step 1970, the drive unit 220 is driven in the anticlockwise direction after step 1970. If the drive unit 220 was driven in the anticlockwise direction, for example, before step 1970, the drive unit 220 is driven in the clockwise direction after step 1970. The interactive program also preferably controls in step 1970 an indication—for example indication 1014, 1016 on the display 1010 in FIG. 16 and/or indications 1185, 1185 on operating unit 1120 in FIG. 14—for indicating the current direction of rotation of the output spindle 310 from FIG. 3.

After the changeover operation has been completed, the interactive program continues with step 1990, during which the interactive program 1342, 1344 preferably makes it possible to activate the drive motor 120 again and returns to step 1902.

The invention claimed is:

1. A hand-held power tool including:

a housing having a handle with a manual switch;

an output spindle;

a drive unit having a drive motor configured to rotationally drive the output spindle and to be changed over between a first direction of rotation and a second direction of rotation in order to drive the output spindle in the first direction of rotation or the second direction of rotation, rotation of the drive motor being activated and deactivated by actuating the manual switch; and the monostable switch being configured to return to the stable rest position in an absence of the actuation by a user, the monostable switch being configured to actuate only in a first direction from the stable rest position;

a direction of rotation detection device configured to detect a current direction of rotation of the drive motor; and control electronics configured to, in response to an actuation of the monostable switch while the drive motor is not rotating, initiate a changeover operation in which (i) if the drive motor was most recently rotated in the first direction of rotation, then driver motor is rotated in the second direction of rotation next time the manual switch is actuated and (ii) if the drive motor was most recently rotated in the second direction of rotation, then driver motor is rotated in the first direction of rotation next time the manual switch is actuated.

2. The hand-held power tool as claimed in claim 1, wherein the monostable switch has a sensor unit configured to generate an actuation signal in response to an actuation of the monostable switch by the user into the unstable switching position.

3. The hand-held power tool as claimed in claim 2, wherein the actuation signal is configured to set a respectively desired direction of rotation of the output spindle.

4. The hand-held power tool as claimed in claim 3, wherein the sensor unit of the monostable switch is at least one of a mechanical sensor, an electrical sensor, a magnetic sensor, and an optical sensor.

5. The hand-held power tool as claimed in claim 1, wherein the direction of rotation detection device is configured to indicate a request to initiate the changeover operation when predefined operating conditions occur.

6. The hand-held power tool as claimed in claim 1, wherein the monostable switch has a switching rocker, a pushbutton, or a slide configured to move between the stable rest position and the unstable switching position.

7. The hand-held power tool as claimed in claim 1, wherein the monostable switch has a spring element configured to move the monostable switch into the stable rest position.

8. The hand-held power tool as claimed in claim 1, wherein the monostable switch has an illumination module is configured to indicate a request to initiate the changeover operation when predefined operating conditions occur.

9. The hand-held power tool as claimed in claim 1, wherein the control electronics are configured to cause the changeover operation only when the drive motor is at a standstill.

10. The hand-held power tool as claimed in claim 9, wherein the control electronics are configured to brake the drive motor to a standstill in order to enable the changeover operation.

11. The hand-held power tool as claimed in claim 1, wherein the monostable switch has a touch-sensitive screen.

12. The hand-held power tool as claimed in claim 11, wherein the touch-sensitive screen of the monostable switch is configured to indicate a request to initiate the changeover operation and to initiate the changeover operation.

13. The hand-held power tool as claimed in claim 1, wherein the power tool is configured as a cordless screwdriver or a cordless drill.

* * * * *